US008794835B2

(12) United States Patent
Wilcoxen et al.

(10) Patent No.: US 8,794,835 B2
(45) **Date of Patent: *Aug. 5, 2014**

(54) DRAW TAPE BAG

(75) Inventors: Kyle R. Wilcoxen, Chicago, IL (US); Robert W. Fraser, Lombard, IL (US)

(73) Assignee: The Glad Products Company, Oakland, CA (US)

( * ) Notice: Subject to any disclaimer, the term of this patent is extended or adjusted under 35 U.S.C. 154(b) by 576 days.

This patent is subject to a terminal disclaimer.

(21) Appl. No.: 12/869,608

(22) Filed: Aug. 26, 2010

(65) Prior Publication Data

US 2011/0052104 A1 Mar. 3, 2011

Related U.S. Application Data

(60) Provisional application No. 61/239,469, filed on Sep. 3, 2009.

(51) Int. Cl.
*B65D 30/02* (2006.01)

(52) U.S. Cl.
USPC ..... 383/118; 383/908; 383/903; 383/119

(58) Field of Classification Search
USPC ..... 383/75, 112, 118, 119, 903, 908
See application file for complete search history.

(56) References Cited

U.S. PATENT DOCUMENTS 3,220,057 A * 11/1965 Walton ..... 425/385
3,224,574 A * 12/1965 McConnell et al. ..... 242/160.1
3,485,437 A * 12/1969 Gruentzel et al. ..... 383/107
3,549,381 A * 12/1970 Kinsinger ..... 426/77
3,550,839 A * 12/1970 Clayton et al. ..... 383/116
3,735,918 A * 5/1973 Tundermann ..... 383/32
3,760,940 A * 9/1973 Bustin ..... 383/35
3,984,047 A * 10/1976 Clayton et al. ..... 383/119
4,153,664 A * 5/1979 Sabee ..... 264/280
4,518,643 A * 5/1985 Francis ..... 428/131
5,028,289 A * 7/1991 Rasmussen ..... 156/229
5,133,607 A 7/1992 Bonke
5,205,650 A 4/1993 Rasmussen
5,390,875 A 2/1995 Gietman et al.
5,518,801 A 5/1996 Chappell et al.
5,554,093 A * 9/1996 Porchia et al. ..... 493/240
5,618,111 A * 4/1997 Porchia et al. ..... 383/63
5,650,214 A * 7/1997 Anderson et al. ..... 428/152
6,059,458 A 5/2000 Belias et al.
6,150,647 A * 11/2000 Anderson et al. ..... 219/730
6,368,444 B1 * 4/2002 Jameson et al. ..... 156/229
6,394,651 B2 * 5/2002 Jackson ..... 383/75
6,402,377 B1 6/2002 Vo et al.
6,513,975 B1 * 2/2003 Jackson et al. ..... 383/118
6,695,476 B2 * 2/2004 Jackson et al. ..... 383/77
6,799,680 B2 * 10/2004 Mak ..... 206/524.8

(Continued)

FOREIGN PATENT DOCUMENTS

WO WO2007/140877 12/2007

*Primary Examiner* — Jes F Pascua
*Assistant Examiner* — Peter Helvey
(74) *Attorney, Agent, or Firm* — Thomas C. Feix

(57) ABSTRACT

The plastic bag with a hem and draw tape may include flexible thermoplastic sidewalls that have a network pattern imparted onto them across the side seams. In one embodiment, the network pattern is below the hem seal. In another embodiment, the network pattern covers the hem seal. The bag may also include a ribbed pattern below the network pattern. The network pattern may be continuous or discontinuous.

19 Claims, 14 Drawing Sheets

(56) References Cited

U.S. PATENT DOCUMENTS

| | | | | |
|---|---|---|---|---|
| 6,921,202 | B2 * | 7/2005 | Raterman | 383/33 |
| 6,939,042 | B2 | 9/2005 | Rusnak | |
| 6,966,697 | B2 | 11/2005 | Patridge et al. | |
| 7,220,053 | B2 * | 5/2007 | Wu | 383/105 |
| 7,300,395 | B2 * | 11/2007 | Sleight et al. | 493/215 |
| 7,687,134 | B2 * | 3/2010 | Withers | 428/156 |
| 7,938,635 | B2 * | 5/2011 | Heilman et al. | 425/101 |
| 2006/0093766 | A1 * | 5/2006 | Savicki et al. | 428/35.2 |
| 2006/0177161 | A1 * | 8/2006 | Turvey | 383/120 |
| 2008/0137995 | A1 | 6/2008 | Fraser et al. | |
| 2010/0046860 | A1 | 2/2010 | Kent et al. | |
| 2010/0046861 | A1 * | 2/2010 | Wilcoxen | 383/119 |
| 2010/0098354 | A1 | 4/2010 | Fraser et al. | |
| 2010/0195937 | A1 * | 8/2010 | Fraser et al. | 383/105 |
| 2011/0052104 | A1 * | 3/2011 | Wilcoxen et al. | 383/75 |
| 2011/0052105 | A1 * | 3/2011 | Wilcoxen et al. | 383/75 |
| 2011/0117307 | A1 * | 5/2011 | Fraser et al. | 428/66.6 |
| 2011/0255809 | A1 * | 10/2011 | Tucker et al. | 383/119 |
| 2011/0317945 | A1 * | 12/2011 | Waldron et al. | 383/119 |
| 2012/0033900 | A1 * | 2/2012 | Fraser et al. | 383/105 |
| 2012/0039550 | A1 * | 2/2012 | Macpherson et al. | 383/109 |
| 2012/0057811 | A1 * | 3/2012 | Tucker et al. | 383/72 |
| 2012/0063706 | A1 * | 3/2012 | Fraser et al. | 383/109 |

* cited by examiner

DRAW TAPE BAG

CROSS-REFERENCE TO RELATED APPLICATIONS

This application claims the benefit of U.S. Provisional Application No. 61/239,469, filed Sep. 3, 2009, which is hereby incorporated by reference in its entirety.

BACKGROUND OF THE INVENTION

1. Field of the Invention

This invention relates generally to bags having a draw tape. More particularly, the present invention relates generally to trash bags having a draw tape.

2. Description of the Related Art

Among their many applications, it is known to use thermoplastic bags as liners in trash or refuse receptacles. Trash receptacles that employ such liners may be found at many locations, such as, small household kitchen garbage cans. Bags that are intended to be used as liners for such refuse containers are typically made from low-cost, pliable thermoplastic material. When the receptacle is full, the thermoplastic liner actually holding the trash may be removed for further disposal and replaced with a new liner.

It is desirable to reduce the cost of producing the disposable thermoplastic bags as much as possible. Therefore, such bags typically are mass-produced in a high speed manufacturing environment. Other cost savings can be realized by reducing the amount or quality of thermoplastic material utilized to make the bag. However, reducing the amount or quality of thermoplastic material forming the bag limits bag strength and toughness and makes the bag susceptible to tearing or rupture. Accordingly, there is a need for a thermoplastic bag designed in a manner that reduces material cost while maintaining strength and toughness characteristics and facilitating high-speed manufacturing.

BRIEF SUMMARY

The bag may be made from flexible, pliable, low-cost thermoplastic material. The bag may include rectangular first and second sidewalls that may be overlaid and joined to each other along a first side edge, a parallel second side edge and a closed bottom edge to delineate an interior volume. The first and second side edges and closed bottom edge may be formed by sealing the thermoplastic material together. To access the interior volume, the top edges of the sidewalls that are opposite the closed bottom edge may remain un-joined or unsealed to provide an opening.

To provide bags that easily fit into trash canisters and yet are strong and easily removed, the bag may contain both ribbed patterned areas and network patterned areas mixed with unpatterned film areas for optimal functional properties of different sections of the bag. For example, the ribbed patterned areas may provide sufficient physical properties and lower surface contact area at lower film thickness and lower basis weight than the unpatterned film. In another example, the network patterned areas may provide additional stretch or elastic properties and lower surface contact than the unpatterned film. Examples of ribbed patterned areas are described in the specification below. Examples of elastic or strainable network patterned areas are described in U.S. Pat. App. 2008/0137995 to Fraser et al., U.S. Pat. No. 5,518,801 to Chappell et al., both of which are incorporated in their entirety herein. Other examples of network patterned areas that may provide lower surface contact include embossing and other techniques.

In a further embodiment, the bag may be provided with additional features to help retain it to the trash canister. These features may include forming the thermoplastic sidewall material between the opposing sides to have a stretchable or yieldable characteristic or stretchable drawstring, for example as described in U.S. Pat. App. 20100046860 and incorporated by reference in its entirety herein. In one embodiment, the sidewall may be formed so that the sheet-like thermoplastic material bunches together as a series of wrinkles or creases. When a pulling force is applied, the bunched together thermoplastic material may un-bunch thereby allowing the bag to stretch or expand. The thermoplastic material may have some shape memory tending to cause the material to re-bunch together, thereby providing an elastic or resilient characteristic to the bag and helping the throat to grip or constrict around the canister. In another embodiment, the bag may have strips of elastic material attached to one or both of the sidewalls and may extend between the converging portions of the first and second side edges. Like the stretchable sidewall material, the strip of elastic material may help grip and retain the bag to the refuse canister.

In one embodiment, at least one sidewall may have a plurality of first ribs formed into the sidewall that have a first height. A second plurality of ribs may also be formed as a network pattern into the sidewall that have a second height that is different than the first height. The ribs and network pattern can lead to lower contact area in the trash can with the result that the filled bag is easier to remove from the trash can.

The plurality of second ribs may be arranged or gathered into discontinuous or differentiated network patterns of parallel, adjacent ribs that may be partially extensive with each other. The second ribs may be formed from thermoplastic material that has been displaced with respect to or stretched outwardly from the plane of the web used to form the bag. The unbending or flattening of the second ribs may expand the network thereby increasing the area of the sidewall and hence the volume of the bag so that the bag may accommodate larger or bulky items.

In another aspect, a thermoplastic web is provided which may be utilized in forming the bag or other items made from thermoplastic sheet material. The thermoplastic web may be processed through the first and second rollers described above to have a first plurality of ribs and a second plurality of ribs. Stretching of the thermoplastic material that accompanies formation of the first ribs may increase the overall area of the web. When a tensioning or pulling force is later applied to the web, the second ribs may unbend or flatten to increase the overall area of the web. The increase of the web area associated with formation of the first ribs provides more web material to process into finished goods. The increase in the web area associated with unbending of the second ribs provides the finished goods with an elastic or yieldable characteristic.

In one aspect, a thermoplastic bag comprises a first sidewall of flexible thermoplastic material; a second sidewall of flexible thermoplastic material overlaying and joined to the first sidewall to form a first sidewall seam along a first side edge, to form a second sidewall seam along an opposite second side edge, and a closed bottom edge, the first and second sidewalls un-joined along respective top edges to define an opening opposite the bottom edge for accessing the interior volume; at least one of the sidewalls forming a hem having a top length and extending along the open top end disposed opposite the bottom edge, the hem having a bottom length and a hem seal, the hem including one or more draw tape notches and a draw tape within the hem; wherein at least one of the first or second sidewalls includes a first portion with a discontinuous network pattern extending linearly between the first side edge and the second side edge and across the first and second sidewall seams; wherein the portion with the discontinuous network pattern extends from above the bottom edge to below the hem seal such that there is a top un-patterned portion below the hem seal; wherein the bag comprises a second portion with a pattern of adjacent, linear ribs extending linearly between the first side edge and the second side edge and across the first and second sidewall seams, the ribs being substantially parallel; wherein the second portion is below the first portion; wherein the first portion has a first average thickness, the second portion has a second average thickness, the second average thickness is less than the first average thickness; wherein the first portion is a strainable network comprising a first region undergoing substantially molecular-level deformation and a second region undergoing substantially geometric deformation.

The bag may be produced by a high speed manufacturing process that processes continuous sheet-like webs of thermoplastic material into the finished bag via automated equipment. The process may include equipment, such as, seal bars, that the web or webs are directed between, that may form the side seals including the converging portions in a single, repeated step. Manufacturing the side seals in a single, repeated step may speed the manufacturing process and may reduce the cost of the finished bags.

In another aspect, the plastic bag may be produced through a high-speed manufacturing process which processes continuous webs of thermoplastic material into finished bags. The process may include adjacent first and second cylindrical rollers that can rotate in opposite rotational directions with respect to each other. The first roller may include a plurality of ridges protruding radially outward from the roller. At least some of the ridges may have segments of a first height and segments of a second height which are greater than the first height. The second roller may also include a plurality of ridges protruding radially outward from its cylindrical roller body. The rollers may be arranged so that the ridges of the first roller are received between the ridges of the second roller.

In operation, the initially planar web of pliable thermoplastic material is directed in between the rotating rollers. The network pattern can be formed by positioning the base film between toothed regions of plate and teeth of plate are incrementally and plastically formed creating rib-like elements in the network patterned regions of web material.

DETAILED DESCRIPTION

Figure 1:
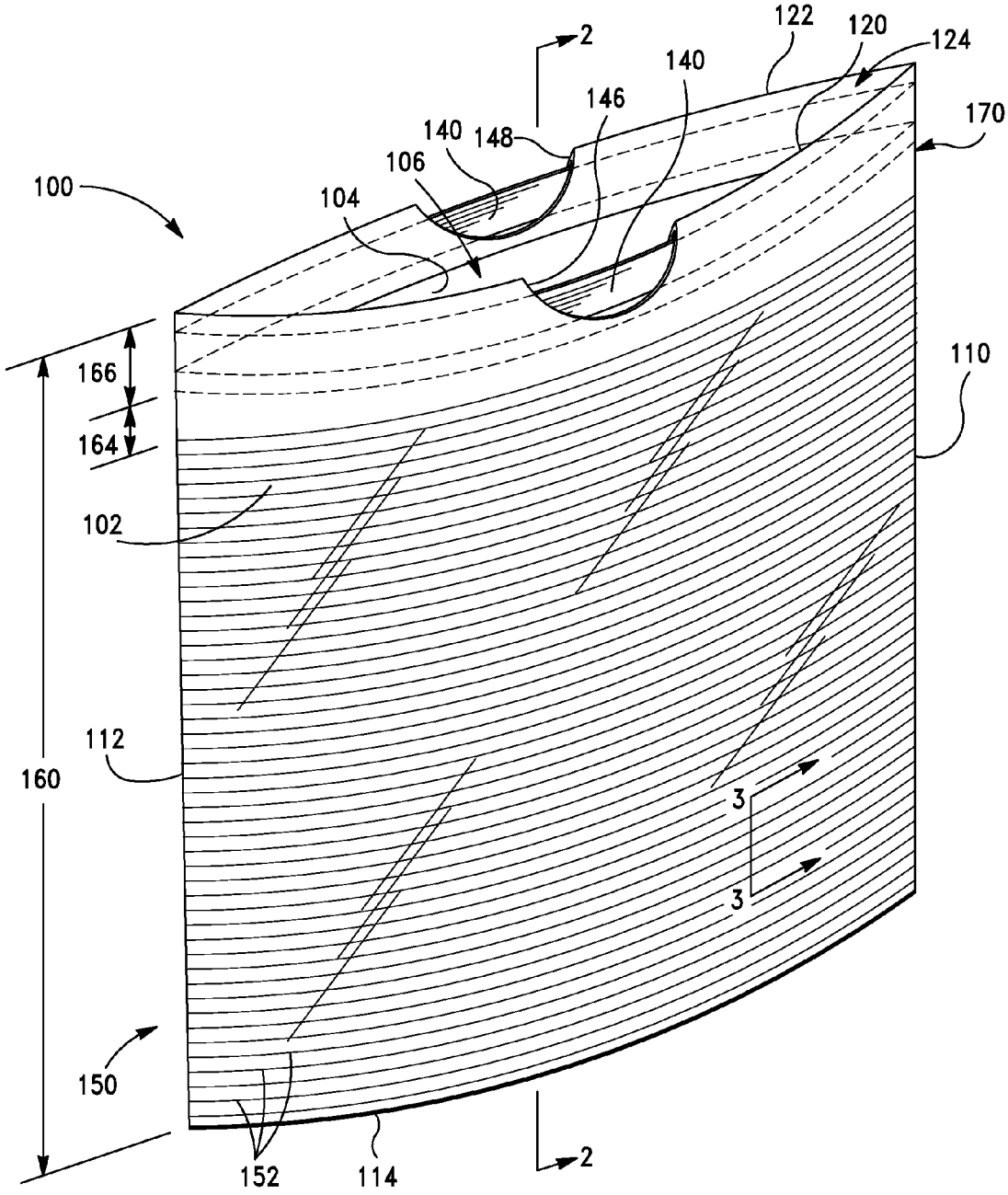
FIG. 1 is a perspective view of a thermoplastic bag for use as a trash container liner having a ribbed pattern imparted onto a sidewall of the bag.

Referring to FIG. 1, an embodiment of a flexible thermoplastic bag 100 is illustrated. While flexible bags are generally capable of holding a vast variety of different contents, the bag 100 illustrated in FIG. 1 may be intended to be used as a liner for a garbage can or similar refuse container. The bag 100 may be made from a first sidewall 102 and an opposing second sidewall 104 overlying the first sidewall to provide an interior volume 106 therebetween. The first and second sidewalls 102, 104 may be joined along a first side edge 110, a parallel or non-parallel second side edge 112, and a closed bottom edge 114 that may extend between the first and second side edges. The sidewalls 102, 104 may be joined along the first and second side edges 110, 112 and bottom edge 114 by any suitable process such as, for example, heat sealing. The bottom edge 114 may be formed by joining the first sidewall 102 to the second sidewall 104 by any suitable process. The bottom edge 114 may be formed by a fold between the first sidewall 102 and the second sidewall 104.

For accessing the interior volume 106 to, for example, insert refuse or garbage, the top edges 120, 122 of the first and second sidewalls 102, 104 may remain un-joined to define an opening 124 located opposite the closed bottom edge 114.

Figure 2:
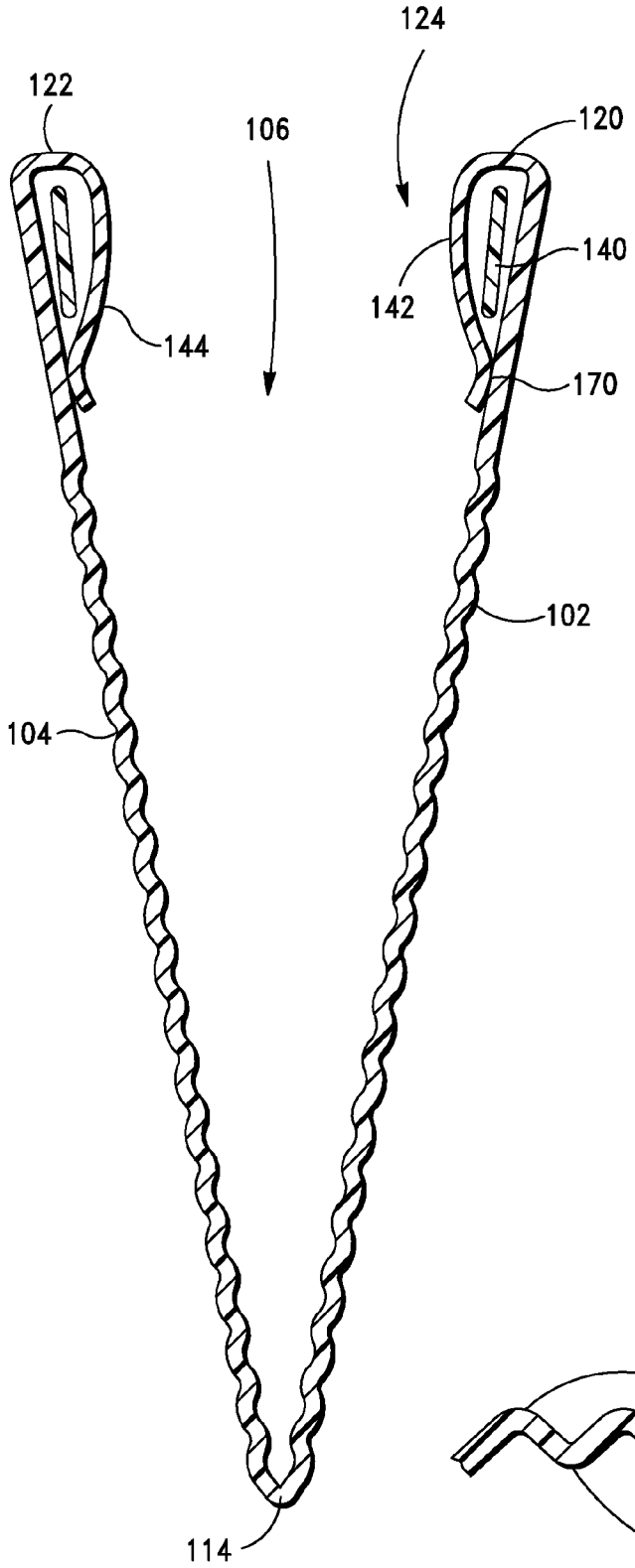
FIG. 2 is a cross-sectional view taken along line 2-2 of FIG. 1.

When placed in a trash receptacle, the top edges 120, 122 of the first and second sidewalls 102, 104 may be folded over the rim of the receptacle. To close the opening 124 of the bag 100 when, for example, disposing of the trash receptacle liner, referring to FIGS. 1 and 2, the bag may be fitted with a draw tape 140. To accommodate the draw tape 140, referring to FIG. 2, the first top edge 120 of the first sidewall 102 may be folded back into the interior volume 106 and attached at the hem seal 170 to the interior surface of the sidewall to form a first hem 142. Similarly, the second top edge 122 of the second sidewall 104 may be folded back into the interior volume and attached to the second sidewall to form a second hem 144. In other embodiments, the hems may be folded to the exterior and attached to the exterior surface of the sidewall(s). The draw tape 140, which may be fixedly attached at the first and second side edges 110, 112, may extend along the first and second top edge 120, 122 through the first and second hems 142, 144. To access the draw tape 140, first and second notches 146, 148 may be disposed through the respective first and second top edges 120, 122. Pulling the draw tape 140 through the notches 146, 148 may constrict the top edges 120, 122 thereby closing the opening 124.

The first and second sidewalls 102, 104 of the plastic bag 100 may be made of flexible or pliable thermoplastic material which may be formed or drawn into a web or sheet. Examples of suitable thermoplastic material may include polyethylene, such as, high density polyethylene, low density polyethylene, very low density polyethylene, ultra low density polyethylene, linear low density polyethylene, polypropylene, ethylene vinyl acetate, nylon, polyester, ethylene vinyl alcohol, ethylene methyl acrylate, ethylene ethyl acrylate, or other materials, or combinations thereof, and may be formed in combinations and in single or multiple layers. When used as a garbage can liner, the thermoplastic material may be opaque but in other applications may be transparent, translucent, or tinted. Furthermore, the material used for the sidewalls may be a gas impermeable material.

Figure 3:
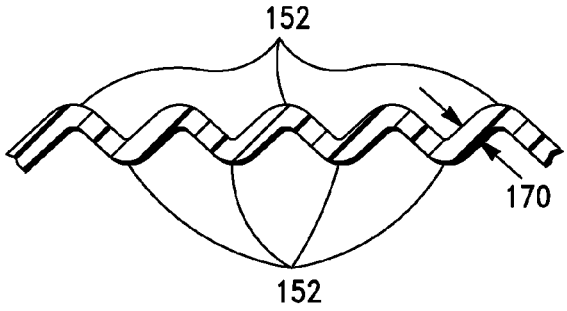
FIG. 3 is cross-sectional view taken along line 3-3 of FIG. 1.

Referring to FIGS. 1 and 3, to provide the bag with desirable physical characteristics, a ribbed pattern 150 may be imparted onto at least a portion of the first sidewall of the bag. The ribbed pattern 150 may take the form of a plurality of linear ribs 152 that may extend across the first sidewall 102 substantially between the first side edge 110 and second side edge 112. As illustrated in FIG. 3, the ribs 152 may be parallel and adjacent to one another such that the thermoplastic material of the sidewall 102 may have a generally corrugated shape. Additionally, as illustrated in FIG. 1, the ribbed pattern 150 may extend from the bottom edge 114 toward the opening 124. To avoid interfering with the operation of the draw tape 140, the extension of the ribbed pattern 150 may terminate below the hem seal 170. The bag 100 may have a height 160 measured between the closed bottom edge 114 and the opening 124. The height 160 may have a first range of about 10 inches to 48 inches, a second range of about 24 inches to 40 inches, and a third range of about 27 inches to 36 inches. In one embodiment, the height 160 may be about 27.4 inches. The hem seal 170 can be a distance 166 below the opening 124. The distance 166 can have a first range of about 1.0 inches to 4.0 inches, a second range of about 1.5 inches to 3.5 inches, and a third range of about 2.0 inches to 3.0 inches. In one embodiment, the distance 166 may be about 2.25 inches. The ribbed pattern 150 can start a distance 164 below the hem seal 170. The distance 164 can have a first range of 0.25 inches to 8.0 inches, a second range of 0.25 inches to 4.0 inches, a third range of 0.5 inches to 2.0 inches. In one embodiment, the distance 164 may be about 1.0 inches.

Figures 4, 5:
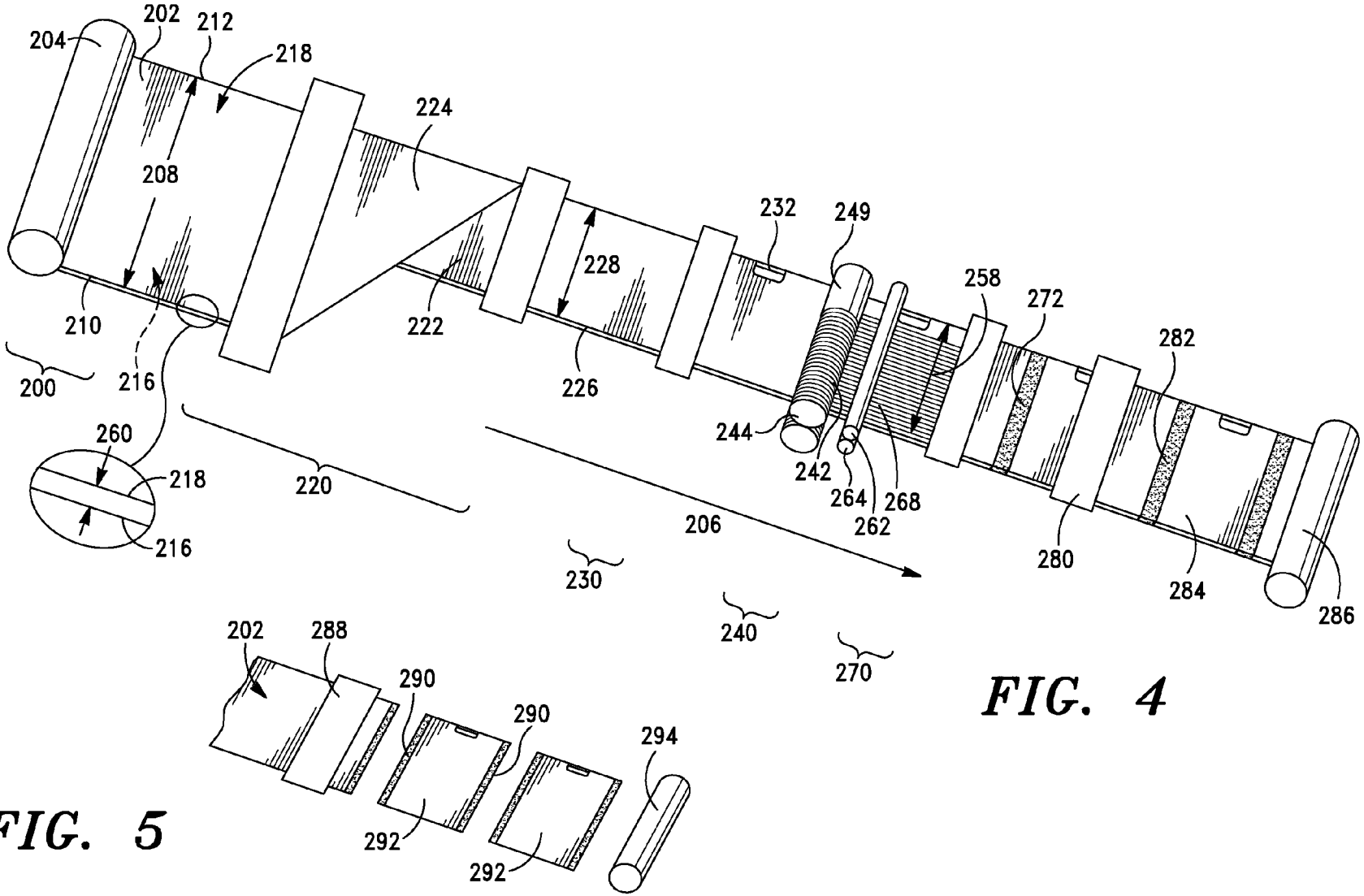
FIG. 4 is a schematic view depicting a high-speed manufacturing process for producing thermoplastic bags having ribbed patterns from a continuous web of thermoplastic material.
FIG. 5 is a schematic view of the final steps of another embodiment of the high-speed manufacturing process.

To produce a bag having a ribbed pattern as described, continuous webs of thermoplastic material may be processed through a high-speed manufacturing environment such as illustrated in FIG. 4. In the illustrated process, production may begin in a step 200 by unwinding a continuous web 202 of thermoplastic sheet material from a roll 204 and advancing the web along a machine direction 206. The unwound web 202 may have a width 208 that may be perpendicular to the machine direction 206 as measured between a first edge 210 and an opposite second edge 212. The unwound web 202 may have an initial average thickness measured between a first surface 216 and a second surface 218. In other manufacturing environments, the web 202 may be provided in other forms or even extruded directly from a thermoplastic forming process.

To provide the first and second sidewalls of the finished bag, the web 202 may be folded into a first half 222 and an opposing second half 224 about the machine direction 206 by a folding operation 220. When so folded, the first edge 210 may be moved adjacent to the second edge 212 of the web. Accordingly, the width of the web proceeding in the machine direction 206 after the folding operation 220 may be a width 228 that may be half the initial width 208 after the unwinding step 200. As may be appreciated, the portion mid-width of the unwound web 202 may become the outer edge 226 of the folded web. In another embodiment, the roll 204 may include a pre-folded web and the folding operation is not necessary. The hems may be formed along the adjacent first and second edges 210, 212 and the draw tape 232 may be inserted during a hem and draw tape operation 230.

To impart the ribbed pattern, the processing equipment may include a first cylindrical roller 242 and a parallel, adjacently arranged second cylindrical roller 244 that may accomplish the imparting process 240. The rollers 242, 244 may be arranged so that their longitudinal axes may be perpendicular to the machine direction 206 and may be adapted to rotate about their longitudinal axes in opposite rotational directions. In various embodiments, motors may be provided that power rotation of the rollers 242, 244 in a controlled manner. The cylindrical rollers may be made of cast and/or machined metal such as steel or aluminum.

Figure 6:
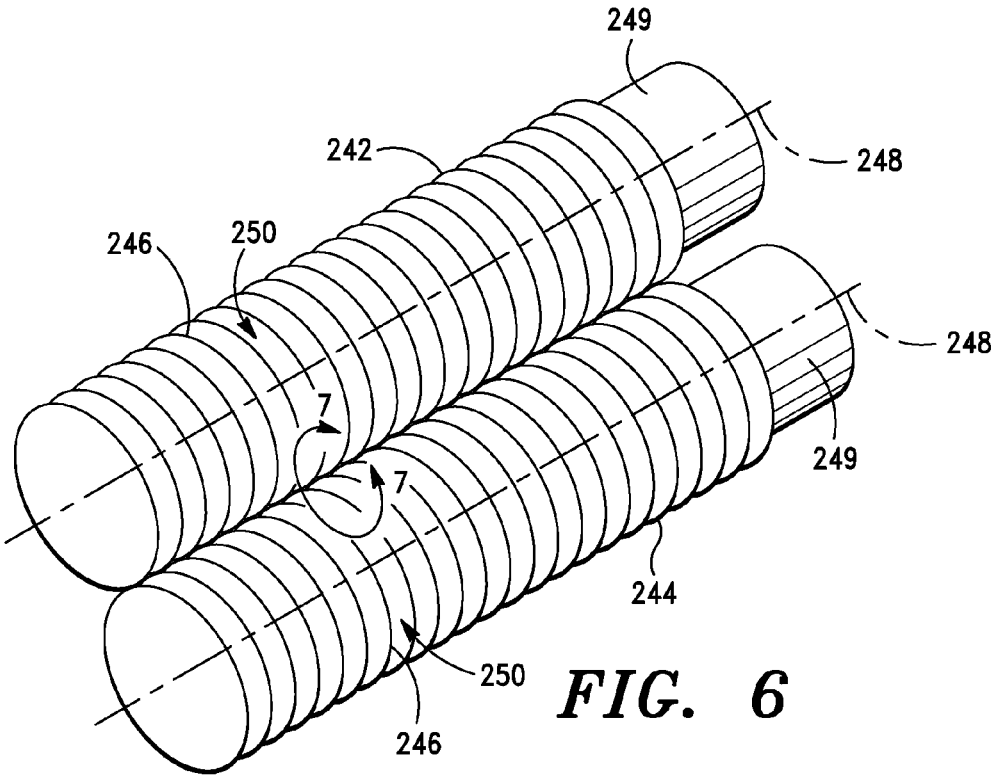
FIG. 6 is a perspective view of the cylindrical rollers, arranged in parallel and adjacent to each other, used to impart the ribbed pattern onto a thermoplastic web.
Figure 7:
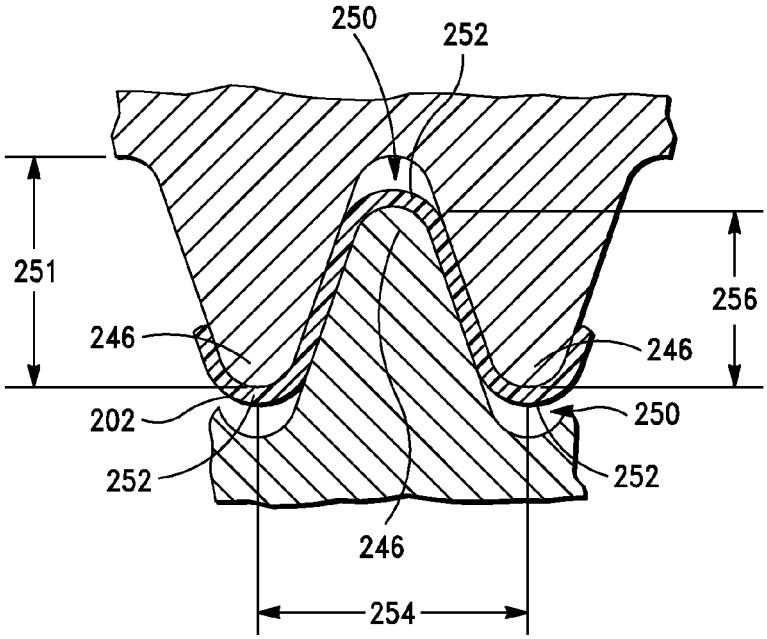
FIG. 7 is a view of the cylindrical rollers taken along circle 7-7 of FIG. 6 depicting the intermeshing of the cylindrical rollers including the protruding circular ridges and the accommodating grooves.

Referring to FIGS. 6 and 7, the cylindrical surface of both the first and second rollers 242, 244 may include a plurality of protruding ridges 246 that may encircle the cylindrical axis 248. The circular ridges 246 may be arranged parallel to one another and may extend along the axial length of the cylinder. Moreover, the circular ridges 246 may be spaced apart from one another to provide corresponding grooves 250 therebetween. The pattern of the circular ridges 246 on the first roller 242 may be axially offset or staggered with respect to the pattern of circular ridges on the second roller 244 such that, when the rollers are aligned adjacently, the ridges of each roller may be received in and accommodated by the grooves 250 of the other roller. In this sense, the alternating ridges and grooves of the two cylindrical rollers may mesh together.

The rollers and the ridge and groove features may have any suitable dimensions, taking into consideration the web material and web size to be processed. The ridges 246 may have a peak height 251 in a first range of about 0.02 inches to 0.4 inches, a second range of about 0.04 inches to 0.2 inches, and a third range of about 0.06 inches to 0.15 inches. In one embodiment, the peak height 251 may be about 0.08 inches. The ridges 246 may have a peak to peak spacing, or pitch 254, in a first range of about 0.02 inches to 0.15 inches, a second range of about 0.03 inches to 0.075 inches, and a third range of about 0.035 inches to 0.05 inches. In one embodiment, the pitch 254 may be about 0.04 inches. The ridges may have a height to pitch ratio in a first range of about 0.5:1 to 4:1, a second range of about 1:1 to 3:1, and a third range of about 1.5:1 to 2.5:1. In one embodiment, the height to pitch ratio may be about 2:1. The longitudinal axes 248 of the rollers 242, 244 may be spaced apart such that only a portion of the circular ridge 246 is received in the corresponding groove 250. The height of the ridge 246 that is actually received within the groove 250 may be termed depth of engagement 256. The depth of engagement 256 may have a first range of about 0.01 inches to 0.055 inches, a second range of about 0.02 inches to 0.045 inches, and a third range of about 0.025 inches to 0.035 inches. In one embodiment, the depth of engagement 256 may be about 0.03 inches.

Referring to FIG. 4, the folded web 202 may be advanced along the machine direction 206 between the first and second rollers 242, 244 which may be set into rotation in opposite rotational directions to impart the resulting web pattern 268. As illustrated in FIG. 7, the ridges 246 may stretch the web 202 into the corresponding grooves 250. The stretching may occur in tensile and shear modes. Also, the meshing action of the ridges and grooves may compress the web. The meshing action of the ridges 246 and grooves 250 may impart onto the web 202 a corrugated or ribbed pattern or shape. The arrangement of alternating circular ridges 246 and corresponding grooves 250 may produce a series of linear ribs 252 onto the web 202, which the web may at least partially maintain after passing between the rollers. Because the circular ridges 246 may be aligned in parallel and spaced apart, the resulting ribs 252 imparted to the web may be parallel to one another and may have the same spacing or pitch. To facilitate patterning of the web 202, the first roller 242 and second roller 244 may be forced or directed against each other by, for example, hydraulic actuators. The pressure at which the rollers are pressed together may be in a first range from 30 PSI (2.04 atm) to 100 PSI (6.8 atm), a second range from 60 PSI (4.08 atm) to 90 PSI (6.12 atm), and a third range from 75 PSI (5.10 atm) to 85 PSI (5.78 atm). In one embodiment, the pressure may be about 80 PSI (5.44 atm).

In the illustrated embodiment, the first and second rollers may be arranged so that they are co-extensive with or wider than the width 228 of the folded web. In one embodiment, the rollers 242, 244 may extend from proximate the outer edge 226 to the adjacent edges 210, 212. To avert imparting the ribbed pattern onto the portion of the web that includes the draw tape 232, the corresponding ends 249 of the rollers 242, 244 may be smooth and without the ridges and grooves. Thus, the adjacent edges 210, 212 and the corresponding portion of the web proximate those edges that pass between the smooth ends 249 of the rollers 242, 244 may not be ribbed.

In one embodiment, the web 202 may be stretched to reduce its thickness as it passes between the rollers. Referring to FIG. 4, the web when it is unwound from the roll 204 may have an average thickness 260, measured between the first surface 216 and a second surface 218. The average thickness 260 may have a first range of about 0.0007 inches to 0.0014 inches, a second range of about 0.0008 inches to 0.0012 inches, and a third range of about 0.0009 inches to 0.0011 inches. In one embodiment, the average thickness may be 0.001 inches. After passing between the rollers 242, 244, the web may have an average thickness 170 as shown in FIG. 3 that is reduced. The average thickness 170 may be in a first range of about 0.0005 inches to 0.0012 inches, a second range of 0.0006 inches to 0.0009 inches, and a third range of about 0.00065 inches to 0.0008 inches. In one embodiment, the average thickness 170 may be about 0.0007 inches. The average thickness may reduced to 85% or less of the original average thickness, or to 90% or less of the first average thickness, or to 80% or less of the first average thickness, or to 70% or less of the first average thickness. Of course, other reductions in average thickness may be possible and may be achieved by varying the initial average thickness of the web, by adjusting spacing of the rollers, and by adjusting the pressure at which the rollers are pressed or forced together.

One result of reducing the thickness of the web material is that the ribbed pattern may be imparted into the web. The thermoplastic material of the web may be stretched or worked during reduction such that the initially planar web takes the new ribbed shape. In some embodiments, the molecular structure of the thermoplastic material may be rearranged to provide this shape memory.

Referring to FIG. 4, another result of reducing the web thickness is that some of the web material may be stretched longitudinally along the rollers 242, 244 and perpendicular to the machine direction 206. Also, some of the web material may be compressed longitudinally along the rollers 242, 244. This action may widen the folded web from its initial width 228 to a larger width 258. To facilitate the widening of the web, the adjacent edges 210, 212 of the web may be located between the smooth ends 249 of the rollers 242, 244. The smooth ends 249 of the rollers 242, 244 can maintain alignment of the web along the machine direction. The processing equipment may include pinch rollers 262, 264 to accommodate the growing width of the widening web.

The processed web may have varying thickness as measured along its width perpendicular of the machine direction. Because the ridges 246 and the grooves 250 on the rollers 242, 244 may not be co-extensive with the width 228 of the folded web 202, only the thickness of that portion of the web which is directed between the ridges and the grooves may be reduced. The remaining portion of the web, such as, toward the adjacent edge 210, 212, may retain the web's original thickness. The smooth ends 249 of the rollers 242, 244 may have diameters dimensioned to accommodate the thickness of that portion of the web which passes therebetween.

To produce the finished bag, the processing equipment may further process the folded web with the ribbed pattern. For example, to form the parallel side edges of the finished bag, the web may proceed through a sealing operation 270 in which heat seals 272 may be formed between the outer edge 226 and the adjacent edges 210, 212. The heat seals may fuse together the adjacent halves 222, 224 of the folded web. The heat seals 272 may be spaced apart along the folded web and in conjunction with the folded outer edge 226 may define individual bags. The heat seals may be made with a heating device, such as, a heated knife. A perforating operation 280 may perforate 282 the heat seals 272 with a perforating device, such as, a perforating knife so that individual bags 290 may be separated from the web. In another embodiment, the web may be folded one or more times before the folded web may be directed through the perforating operation. The web 202 embodying the finished bags 284 may be wound into a roll 286 for packaging and distribution. For example, the roll 286 may be placed in a box or a bag for sale to a customer.

In another embodiment of the process which is illustrated in FIG. 5, a cutting operation 288 may replace the perforating operation 280 in FIG. 4. Referring to FIG. 5, the web is directed through a cutting operation 288 which cuts the web at location 290 into individual bags 292 prior to winding onto a roll 294 for packaging and distribution. For example, the roll 294 may be placed in a box or bag for sale to a customer. The bags may be interleaved prior to winding into the roll 294. In another embodiment, the web may be folded one or more times before the folded web is cut into individual bags. In another embodiment, the bags 292 may be positioned in a box or bag, and not onto the roll 294. The bags may be interleaved prior to positioning in the box or bag.

These manufacturing embodiments may be used with any of the manufacturing embodiments described herein, as appropriate.

A possible advantage of imparting the ribbed pattern onto the sidewall of the finished bag is that toughness of the thermoplastic bag material may be increased. For example, toughness may be measured by the tensile energy to yield of a thermoplastic film or web. This measure represents the energy that the web material may incur as it is pulled or placed in tension before it yields or gives way. The tensile energy to yield quality can be tested and measured according to various methods and standards, such as those set forth in ASTM D882-02, herein incorporated by reference in its entirety.

In particular, a web, which is processed to have a ribbed pattern imparted onto it by rollers, may demonstrate a higher tensile energy to yield in the transverse direction ("TD"), which is perpendicular to the machine direction ("MD") according to which the web is processed. By way of example only, a linear low density polyethylene web having an initial average thickness of 0.0009 inches (0.0023 cm) was run between a pair of rollers having circular ridges at a 0.04 inch (0.1 cm) pitch, a depth of engagement ("DOE") of 0.035 inches (0.09 cm), a roller pressure of 60 PSI (4.08 atm), and a speed of 300 feet per minute (91.4 meters per minute). The web had an initial tensile yield of 1.50 lbf. (6.7 N) in the transverse direction and an initial tensile energy to yield of 0.274 in-lbf (0.031 J) in the transverse direction. After imparting the ribbed pattern, the web had a tensile yield of 1.43 lbf (6.36 N), a tensile energy to yield of 0.896 in-lbf (0.101 J) and an average thickness of 0.00077 inches (0.002 cm). The following table sets forth the change in these values.

TABLE 1

| Characteristic/Material | Initial Unprocessed Web | Processed Web |
|---|---|---|
| TD Tensile Yield | 1.50 lbf (6.67 N) | 1.43 lbf (6.36 N) |
| TD Tensile Energy To Yield | 0.274 in-lbf (0.031 J) | 0.896 in-lbf (0.101 J) |

By way of further example, a different linear low density polyethylene web having an initial average thickness of 0.0008 inches (0.002 cm) mils was run between a pair of rollers having circular ridges at a 0.04 inch (0.1 cm) pitch and a depth of engagement ("DOE") of 0.02 inches (0.051 cm), a roller pressure of 60 PSI (4.08 atm), and a speed of 300 feet per minute (91.4 meters per minute). The web had an initial tensile yield of 1.39 lbf (6.18 N) in the transverse direction and an initial tensile energy to yield of 0.235 in-lbf (0.027 J) in the transverse direction. After imparting the ribbed pattern, the web had a tensile yield of 1.38 lbf (6.14 N) and a tensile energy to yield of 0.485 in-lbf (0.055 J) and an average thickness of 0.00075 inches (0.0019 cm). The following table sets forth the change in these values.

TABLE 2

| Characteristic/Material | Initial Unprocessed Web | Processed Web |
|---|---|---|
| TD Tensile Yield | 1.39 lbf (6.18 N) | 1.38 lbf (6.14 N) |
| TD Tensile Energy to Yield | 0.235 in-lbf (0.027 J) | 0.485 in-lbf (0.055 J) |

Thus, imparting the ribbed pattern onto the thermoplastic web may increase the tensile energy to yield by a factor of 2 or greater without a substantial decrease in the tensile yield. When a thermoplastic bag may be manufactured according to the process set forth in FIG. 4, it may be appreciated that the transverse direction of the processed web corresponds to the bag length measured between the closed bottom end and the opened top end. Thus, the toughness of the bag may be increased in the lengthwise direction. The lengthwise direction may be the lift direction of the bag.

Another possible advantage of reducing the thickness of the web via imparting the web with a ribbed pattern is that the ultimate tensile strength may remain relatively consistent even though the web thickness might be reduced. For example, a thermoplastic web having an initial average thickness of 0.0012 inches (0.003 cm) and an ultimate tensile load of about 6.2 lbf (27.6 N) was processed between rollers to impart a ribbed pattern such as those described herein. The web was run between a pair of rollers having circular ridges at a pitch of 0.04 inches (0.1 cm), a depth of engagement of 0.045 inches (0.114 cm), a roller pressure of 40 PSI (2.72 atm), and a speed of 300 feet per minute (91.4 meters per minute). The processed film had an average thickness of about 0.00073 inches (0.00185 cm) and an ultimate tensile load of about 5.8 lbf (25.8 N). The results are set forth in the following table.

TABLE 3

| Material/Characteristic | Average Thickness | Ultimate Tensile Load |
|---|---|---|
| Initial Unprocessed Web | 0.0012 inches (0.003 cm) | 6.2 lbf (27.6 N) |
| Processed Web | 0.00073 inches (0.00185 cm) | 5.8 lbf (25.8 N) |

Another example of the advantages of reducing the thickness of the web without significantly altering the transverse ultimate tensile strength is shown for a web having an initial average thickness of 0.0009 inches (0.0023 cm) and an ultimate tensile load of about 4.8 lbf (21.4 N). The web was processed between rollers to impart a ribbed pattern such as those described herein. The web was run between a pair of rollers having circular ridges at a pitch of 0.04 inches (0.1 cm), a depth of engagement of 0.03 inches (0.076 cm), a roller pressure of 80 PSI (5.44 atm), and a speed of 300 feet per minute (91.4 meters per minute). The processed web had an average thickness of about 0.00073 inches (0.00185 cm) and an ultimate tensile strength of 4.4 lbf (19.6 N). The results are set forth in the following table.

TABLE 4

| Material/Characteristic | Average Thickness | Ultimate Tensile Load |
|---|---|---|
| Initial Unprocessed Web | 0.0009 inches (0.0023 cm) | 4.8 lbf (21.4 N) |
| Processed Web | 0.00073 inches (0.00185 cm) | 4.4 lbf (19.6 N) |

As may be appreciated, even though the average thickness of the 0.0012 inches (0.003 cm) web was reduced by almost 40% from its original average thickness, the ultimate tensile load was only reduced about 6.5%. While the 0.0009 inches (0.0023 cm) average thickness web was reduced by almost 25% from its original average thickness, the ultimate tensile load was only reduced about 8.3%. The comparison between the processed 0.0012 inches (0.003 cm) web and 0.0009 inches (0.0023 cm) web which both were processed to an average thickness of about 0.00073 inches (0.00185 cm), show that the ultimate tensile strength of the processed web is directly related to the initial unprocessed web's ultimate tensile strength. Imparting the ribbed pattern to the web reduces the average thickness in a range of about 5% to 40%, with a corresponding reduction in ultimate tensile load of about 0% to 8.3%. Thus, the ultimate tensile load of the web processed with a ribbed pattern remains substantially consistent with its initial unprocessed web despite having its average thickness reduced.

In addition to the above results, it has also been noticed that imparting the ribbed pattern to the webs made into thermoplastic bags alters the tear resistance of the web. The tear resistance of a thermoplastic web may be measured according to the methods and procedures set forth in ASTM D882-02, herein incorporated by reference in its entirety. By way of example only, a polyethylene web typically has a greater resistance to tear in the transverse direction that is perpendicular to the machine direction in which the web is processed. This web is characterized as having properties imbalanced in the machine direction. However, after passing the web between rollers to impart the ribbed pattern, the tear resistance may be changed. The web may become more balanced where the transverse and machine direction tear resistances may be about equal. Or it may experience greater change to become imbalanced in the transverse direction, where the tear resistance may be switched such that the tear resistance may be greater in the machine direction than in the transverse direction.

Additionally, as described herein, applying the ribbed pattern to just a portion of the web width may result in widening the web. For example, a web may have an initial width of 22.375 inches (56.8 cm) and an initial average thickness of about 0.0014 inches (0.0036 cm). The web may be passed between two rollers such as those described herein which may have ridges and grooves that may be 16.375 (41.6 cm) inches in length. The rollers may be arranged so that the average thickness of the web may be reduced from 0.0014 inches (0.0036 cm) to about 0.0009 inches (0.0023 cm) for that portion passed between the ridges and grooves. The reduction in average thickness may be accompanied by displacement in the web material such that the overall width of the web may expand to about 29.875 inches (75.9 cm), i.e. an increase of about 7.5 inches (19.1 cm). Thus, referring back to FIG. 1, a finished bag 100 made from the processed web may have a greater height measured between the opening 124 and the closed bottom edge 114.

Additionally, as also described herein, because only that portion of the web which passes between the ridges and grooves may have its average thickness reduced, the remaining portion of the web which is made into the bag may remain at the original average thickness of 0.0014 inches (0.0036 cm). The processing equipment may be arranged so that the thicker web material may correspond to those portions of the finished bag in which thicker material is advantageous. For example, referring to FIG. 1, the portion of the web which does not pass through the ridges and grooves may correspond to the top portion of the bag which may include the draw tape 140. Thus, the top portion of the bag may be reinforced by the thicker material. In other embodiments, the web may be processed so that the thicker material may be directed to other portions of the finished bag, such as the bottom portion shown in FIGS. 10, 11 and/or 12, that may otherwise be susceptible to rupture and/or puncture.

A possible advantage may result from arranging the ribbed pattern as a plurality of parallel, linear ribs and only along a portion of the width of the web. In the manufacturing process illustrated in FIG. 4, because the ribbed pattern may be imparted by directing the adjacent web halves 222, 224 between the rollers 242, 244, the ribbed web halves may have a tendency to interlock together. However, because the adjacent edges 210, 212 of the web 202 may be unpatterned, the web halves 222, 224 may be easily separated at the edges in a manner that may provide an impetus for separating a remainder of the web halves. Additionally, the parallel linear arrangement of ribs may facilitate unlocking the web halves. Thus, as may be appreciated, it may be easier to open a finished bag for use as a trash receptacle liner.

Figure 8:
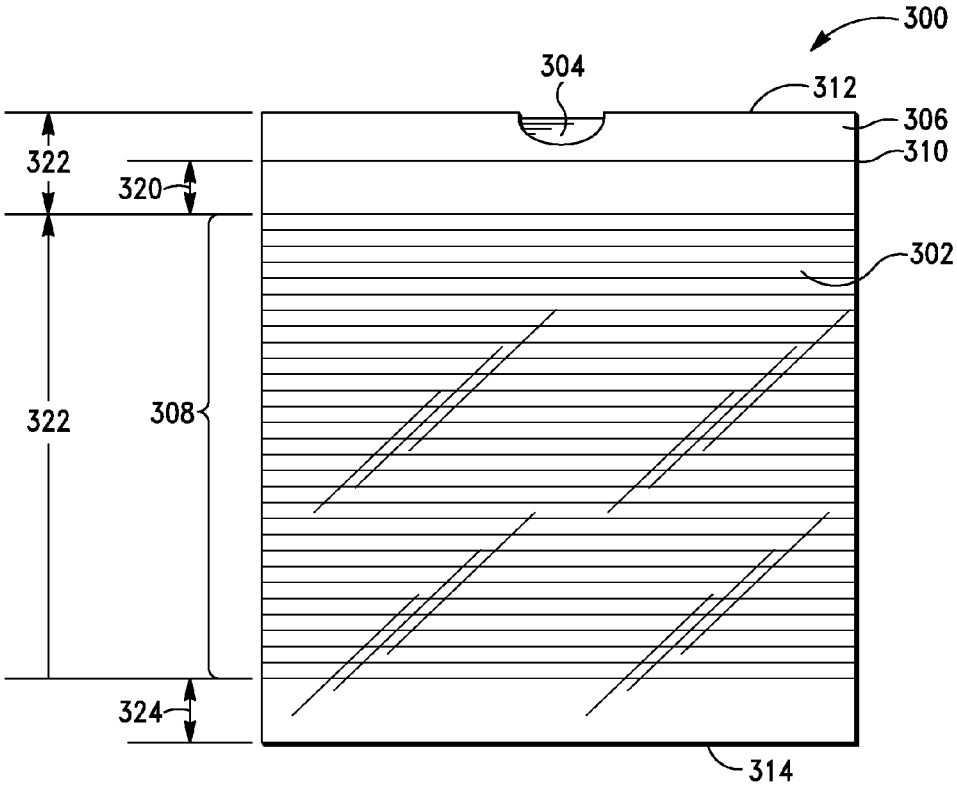
FIG. 8 is a front elevational view of another embodiment of the thermoplastic bag for use as a trash receptacle liner.

Referring now to FIG. 8, there is illustrated another embodiment of a bag 300 for use as a trash receptacle liner. The bag 300 may include a first sidewall 302 of thermoplastic material, a draw tape 304, a hem 306, and a ribbed pattern area 308. The ribbed pattern area 308 is a distance 320 below the hem seal 310 and a distance 322 below the bag top 312. The ribbed patterned area 308 does not reach to the bag bottom 314 but is a distance 324 from the bag bottom 314. The ribbed patterned area 308 extends a distance 326 from top to bottom and typically extends across the entire width of the bag. The distance 322 can have a first range of about 1.0 inches to 8.0 inches, a second range of about 1.5 inches to 4.0 inches, and a third range of about 2.0 inches to 3.0 inches. In one embodiment, the distance 322 may be about 2.5 inches. The distance 320 can have a first range of 0.25 inches to 7.0 inches, a second range of 0.25 inches to 4.0 inches, a third range of 0.5 inches to 2.0 inches. In one embodiment, the distance 320 may be about 1.0 inches. The distance 324 can have a first range of 0.25 inches to 12.0 inches, a second range of 0.5 inches to 8.0 inches, a third range of 0.5 inches to 4.0 inches. In one embodiment, the distance 320 may be about 4.0 inches. The distance 326 can have a first range of 10.0 inches to 22.0 inches, a second range of 12.0 inches to 21.0 inches, a third range of 14.0 inches to 20.0 inches. In one embodiment, the distance 320 may be about 21.0 inches.

Figure 9:
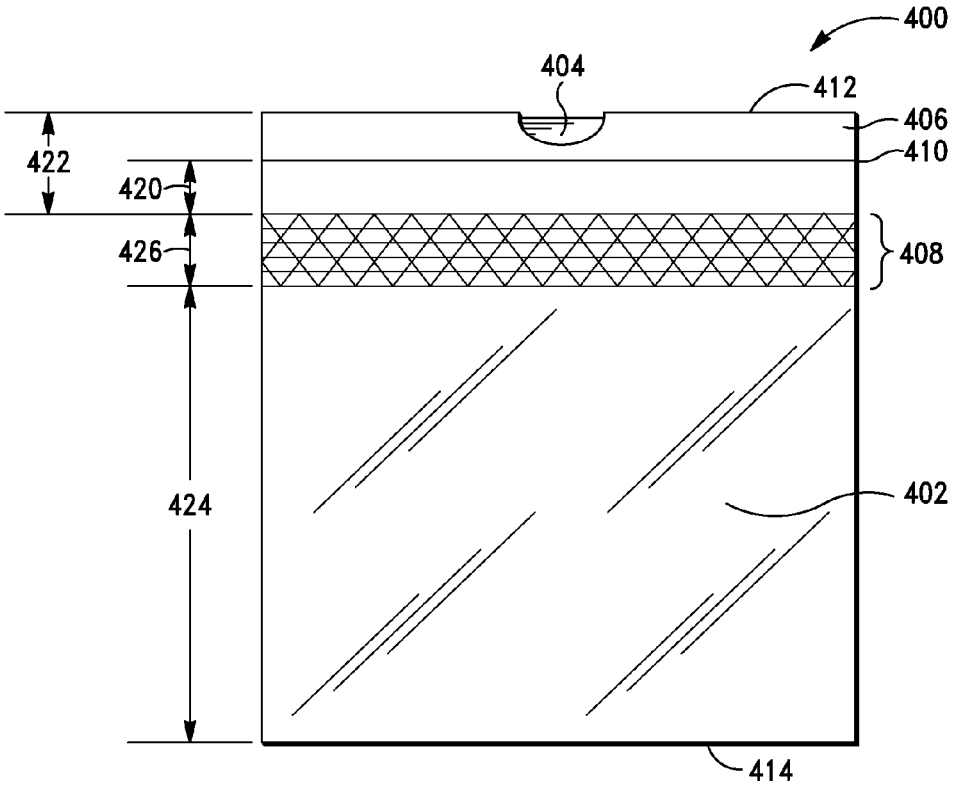
FIG. 9 is a front elevational view of another embodiment of the thermoplastic bag for use as a trash receptacle liner.

Referring now to FIG. 9, there is illustrated another embodiment of a bag 400 for use as a trash receptacle liner. The bag 400 may include a first sidewall 402 of thermoplastic material, a draw tape 404, a hem 406, and a network pattern area 408. The network pattern area 408 is a distance 420 below the hem seal 410 and a distance 422 below the bag top 412. The network patterned area 408 does not reach to the bag bottom 414 but is a distance 424 from the bag bottom 414. The network patterned area 408 extends a distance 426 from top to bottom and typically extends across the entire width of the bag. Although the network patterned area 408 may result in greater loft to the film, the average thickness does not appreciably change compared to the unpatterned area. In one example, there is a consistent film thickness of about 0.95 mil from the bag top 412 to the bag bottom 414.

The distance 422 can have a first range of about 1.0 inches to 8.0 inches, a second range of about 1.5 inches to 4.0 inches, and a third range of about 2.0 inches to 3.0 inches. In one embodiment, the distance 422 may be about 2.5 inches. The distance 420 can have a first range of 0.25 inches to 7.0 inches, a second range of 0.25 inches to 4.0 inches, a third range of 0.5 inches to 2.0 inches. In one embodiment, the distance 420 may be about 1.0 inches. The distance 424 can have a first range of 0.25 inches to 24.0 inches, a second range of 4.0 inches to 22.0 inches, a third range of 10.0 inches to 21.0 inches. In one embodiment, the distance 420 may be about 20.0 inches. The distance 426 can have a first range of 1.0 inches to 7.0 inches, a second range of 1.0 inches to 4.0 inches, a third range of 1.0 inches to 2.0 inches. In one embodiment, the distance 426 may be about 1.5 inches.

Figure 10:
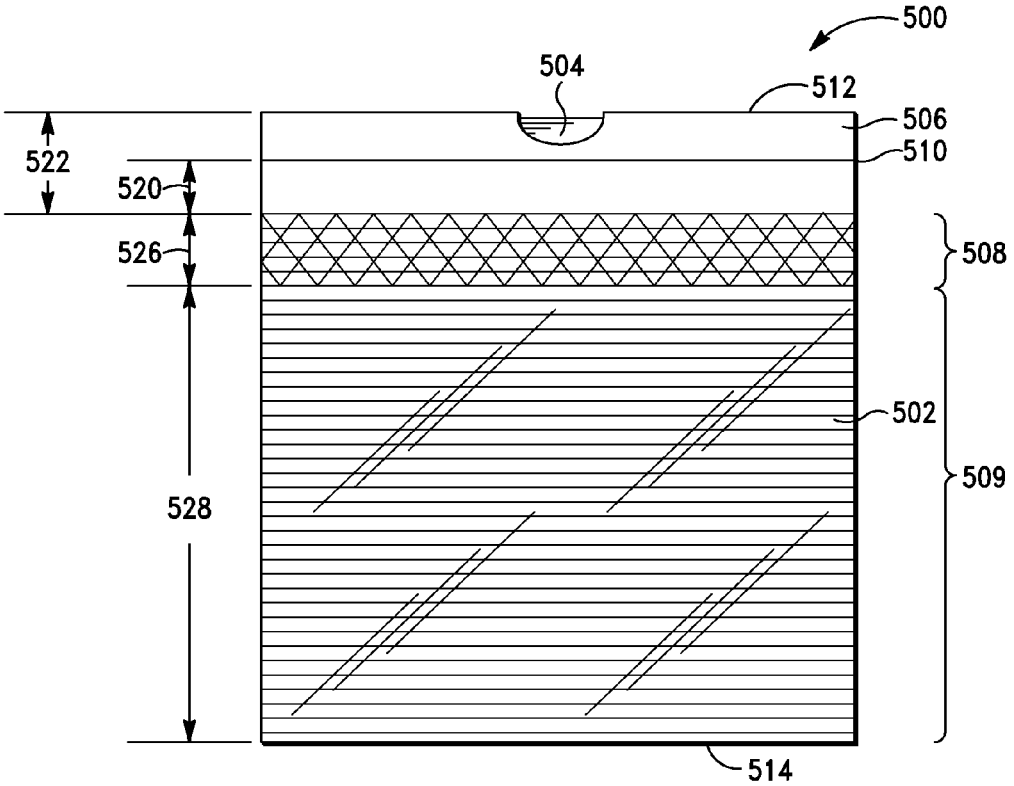
FIG. 10 is a front elevational view of another embodiment of the thermoplastic bag for use as a trash receptacle liner.

Referring now to FIG. 10, there is illustrated another embodiment of a bag 500 for use as a trash receptacle liner. The bag 500 may include a first sidewall 502 of thermoplastic material, a draw tape 504, a hem 506, a network pattern area 508 and a ribbed patterned area 509. The network patterned area 508 is a distance 520 below the hem seal 510 and a distance 522 below the bag top 512. The network patterned area 508 borders the ribbed patterned area 509. The ribbed patterned area 509 reaches to the bag bottom 514. The network patterned area 508 extends a distance 526 from top to bottom and typically extends across the entire width of the bag. The ribbed patterned area 509 extends a distance 528 from top to bottom and typically extends across the entire width of the bag. The distance 522 can have a first range of about 1.0 inches to 8.0 inches, a second range of about 1.5 inches to 4.0 inches, and a third range of about 2.0 inches to 3.0 inches. In one embodiment, the distance 522 may be about 2.5 inches. The distance 520 can have a first range of 0.25 inches to 7.0 inches, a second range of 0.25 inches to 4.0 inches, a third range of 0.5 inches to 2.0 inches. In one embodiment, the distance 520 may be about 1.0 inches. The distance 526 can have a first range of 0.25 inches to 12.0 inches, a second range of 0.5 inches to 8.0 inches, a third range of 0.5 inches to 4.0 inches. In one embodiment, the distance 526 may be about 4.0 inches. The distance 528 can have a first range of 10.0 inches to 22.0 inches, a second range of 12.0 inches to 21.0 inches, a third range of 14.0 inches to 20.0 inches. In one embodiment, the distance 528 may be about 21.0 inches.

Although the network patterned area 508 may result in greater loft to the film, the average thickness does not appreciably change compared to the unpatterned area. In one example, there is a consistent film thickness of about 0.95 mil in the network patterned and unpatterned areas and a film thickness of about 0.8 mil in the ribbed patterned area 509.

Figure 11:
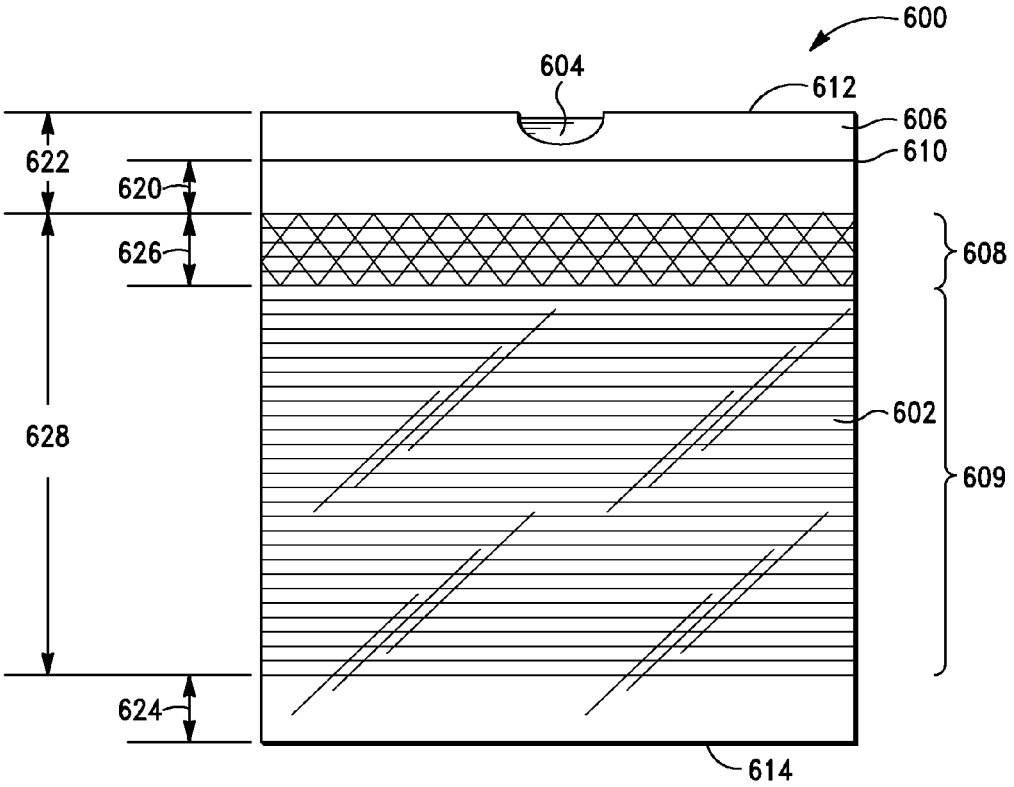
FIG. 11 is a front elevational view of another embodiment of the thermoplastic bag for use as a trash receptacle liner.

Referring now to FIG. 11, there is illustrated another embodiment of a bag 600 for use as a trash receptacle liner. The bag 600 may include a first sidewall 602 of thermoplastic material, a draw tape 604, a hem 606, a network pattern area 608 and a ribbed patterned area 609. The network patterned area 608 is a distance 620 below the hem seal 610 and a distance 622 below the bag top 612. The network patterned area 608 borders the ribbed patterned area 609. The ribbed patterned area 609 does not reach to the bag bottom 614 but is a distance 624 from the bag bottom 614.

The network patterned area 608 extends a distance 626 from top to bottom and typically extends across the entire width of the bag. The ribbed patterned area 609 extends a distance 628 from top to bottom and typically extends across the entire width of the bag. The distance 622 can have a first range of about 1.0 inches to 8.0 inches, a second range of about 1.5 inches to 4.0 inches, and a third range of about 2.0 inches to 3.0 inches. In one embodiment, the distance 622 may be about 2.5 inches. The distance 620 can have a first range of 0.25 inches to 7.0 inches, a second range of 0.25 inches to 4.0 inches, a third range of 0.5 inches to 2.0 inches. In one embodiment, the distance 620 may be about 1.0 inches. The distance 624 can have a first range of 0.25 inches to 12.0 inches, a second range of 0.5 inches to 8.0 inches, a third range of 0.5 inches to 4.0 inches. In one embodiment, the distance 624 may be about 4.0 inches. The distance 626 can have a first range of 0.25 inches to 12.0 inches, a second range of 0.5 inches to 8.0 inches, a third range of 0.5 inches to 4.0 inches. In one embodiment, the distance 626 may be about 4.0 inches. The distance 628 can have a first range of 10.0 inches to 22.0 inches, a second range of 12.0 inches to 21.0 inches, a third range of 14.0 inches to 20.0 inches. In one embodiment, the distance 628 may be about 21.0 inches.

Figure 12:
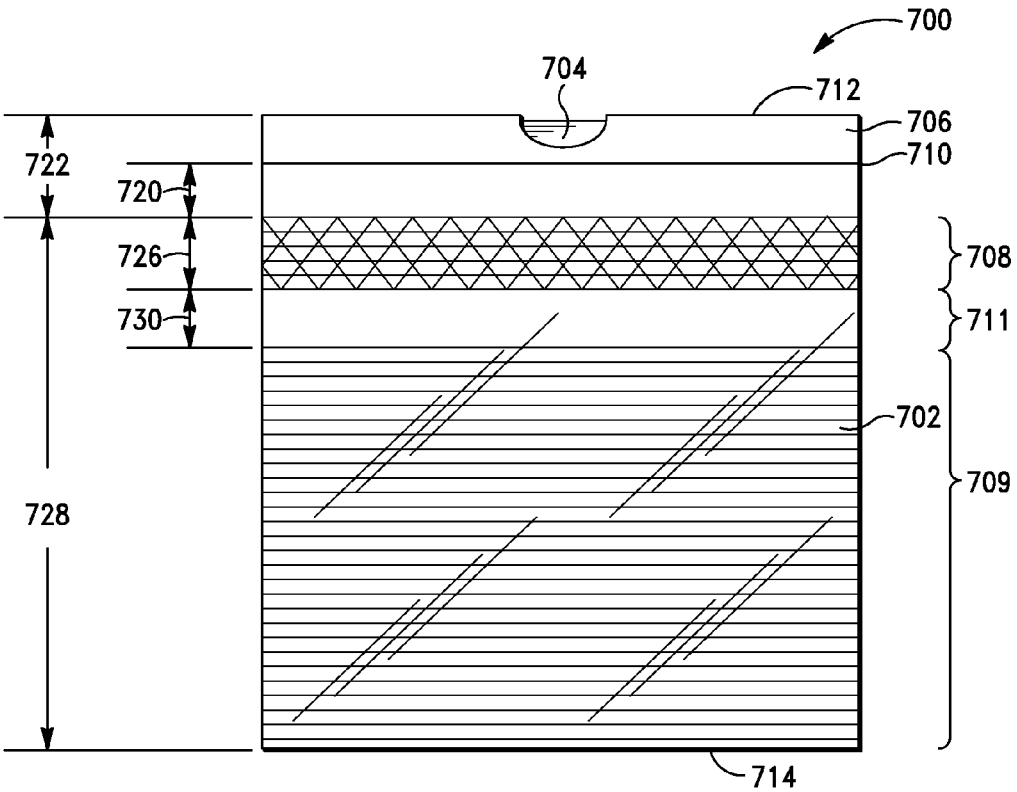
FIG. 12 is a front elevational view of another embodiment of the thermoplastic bag for use as a trash receptacle liner.

Referring now to FIG. 12, there is illustrated another embodiment of a bag 700 for use as a trash receptacle liner. The bag 700 may include a first sidewall 702 of thermoplastic material, a draw tape 704, a hem 706, a network pattern area 708 and a ribbed patterned area 709. The network patterned area 708 is a distance 720 below the hem seal 710 and a distance 722 below the bag top 712. The network patterned area 708 is separated from the ribbed patterned area 709 by an unpatterned area 711. The unpatterned area 711 extends a distance 730 from top to bottom. The ribbed patterned area 709 reaches to the bag bottom 714. The network patterned area 708 extends a distance 726 from top to bottom and typically extends across the entire width of the bag. The ribbed patterned area 709 extends a distance 728 from top to bottom and typically extends across the entire width of the bag. The distance 722 can have a first range of about 1.0 inches to 8.0 inches, a second range of about 1.5 inches to 4.0 inches, and a third range of about 2.0 inches to 3.0 inches. In one embodiment, the distance 722 may be about 2.5 inches. The distance 720 can have a first range of 0.25 inches to 7.0 inches, a second range of 0.25 inches to 4.0 inches, a third range of 0.5 inches to 2.0 inches. In one embodiment, the distance 720 may be about 1.0 inches. The distance 726 can have a first range of 0.25 inches to 12.0 inches, a second range of 0.5 inches to 8.0 inches, a third range of 0.5 inches to 4.0 inches. In one embodiment, the distance 726 may be about 4.0 inches. The distance 728 can have a first range of 10.0 inches to 22.0 inches, a second range of 12.0 inches to 21.0 inches, a third range of 14.0 inches to 20.0 inches. In one embodiment, the distance 728 may be about 21.0 inches. The distance 730 can have a first range of 0.25 inches to 7.0 inches, a second range of 0.25 inches to 4.0 inches, a third range of 0.5 inches to 2.0 inches. In one embodiment, the distance 730 may be about 1.0 inches.

Figure 13:
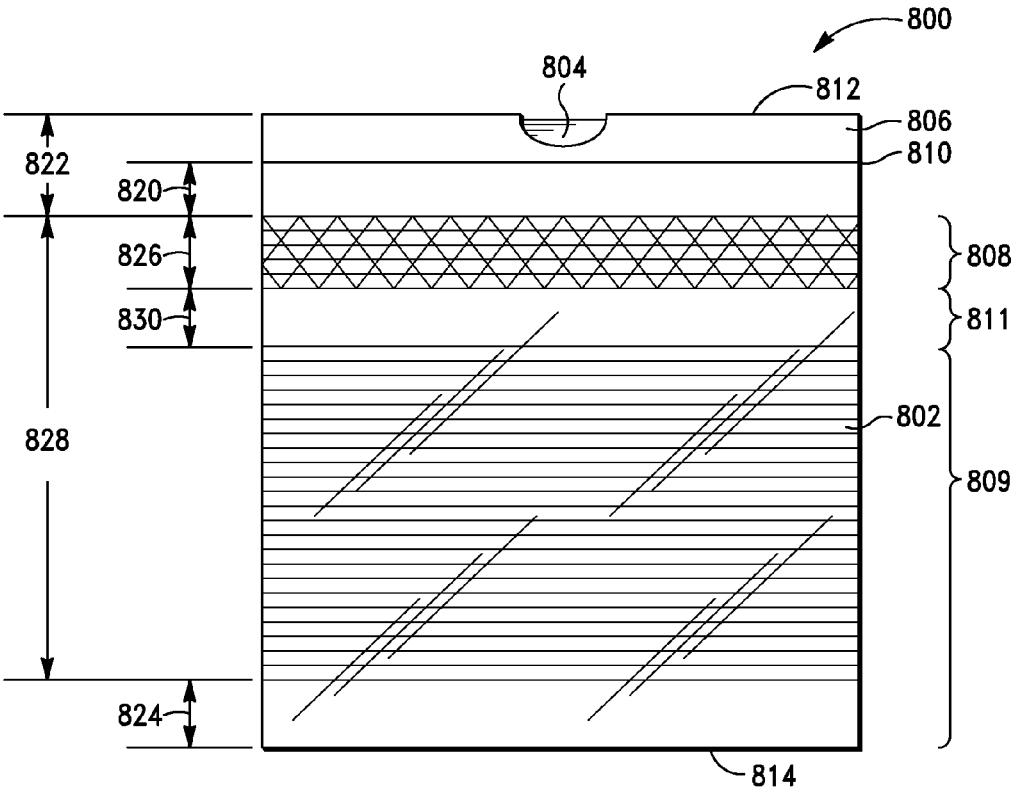
FIG. 13 is a front elevational view of another embodiment of the thermoplastic bag for use as a trash receptacle liner.

Referring now to FIG. 13, there is illustrated another embodiment of a bag 800 for use as a trash receptacle liner. The bag 800 may include a first sidewall 802 of thermoplastic material, a draw tape 804, a hem 806, a network pattern area 808 and a ribbed patterned area 809. The network patterned area 808 is a distance 820 below the hem seal 810 and a distance 822 below the bag top 812. The network patterned area 808 is separated from the ribbed patterned area 809 by an unpatterned area 811. The unpatterned area 811 extends a distance 830 from top to bottom. The ribbed patterned area 809 does not reach to the bag bottom 814 but is a distance 824 from the bag bottom 814. The network patterned area 808 extends a distance 826 from top to bottom and typically extends across the entire width of the bag. The ribbed patterned area 809 extends a distance 828 from top to bottom and typically extends across the entire width of the bag. The distance 822 can have a first range of about 1.0 inches to 8.0 inches, a second range of about 1.5 inches to 4.0 inches, and a third range of about 2.0 inches to 3.0 inches. In one embodiment, the distance 822 may be about 2.5 inches. The distance 820 can have a first range of 0.25 inches to 7.0 inches, a second range of 0.25 inches to 4.0 inches, a third range of 0.5 inches to 2.0 inches. In one embodiment, the distance 820 may be about 1.0 inches. The distance 826 can have a first range of 0.25 inches to 12.0 inches, a second range of 0.5 inches to 8.0 inches, a third range of 0.5 inches to 4.0 inches. In one embodiment, the distance 826 may be about 4.0 inches. The distance 824 can have a first range of 0.25 inches to 12.0 inches, a second range of 0.5 inches to 8.0 inches, a third range of 0.5 inches to 4.0 inches. In one embodiment, the distance 824 may be about 4.0 inches. The distance 828 can have a first range of 10.0 inches to 22.0 inches, a second range of 12.0 inches to 21.0 inches, a third range of 14.0 inches to 20.0 inches. In one embodiment, the distance 828 may be about 21.0 inches. The distance 830 can have a first range of 0.25 inches to 7.0 inches, a second range of 0.25 inches to 4.0 inches, a third range of 0.5 inches to 2.0 inches. In one embodiment, the distance 830 may be about 1.0 inches.

Figure 14:
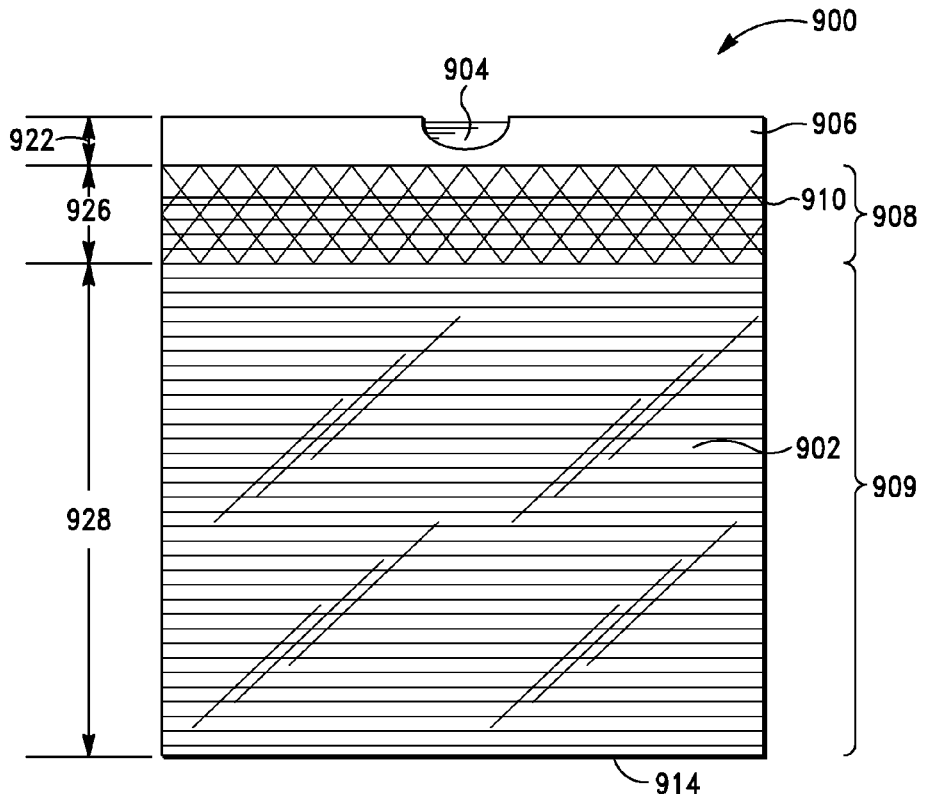
FIG. 14 is a front elevational view of another embodiment of the thermoplastic bag for use as a trash receptacle liner.

Referring now to FIG. 14, there is illustrated another embodiment of a bag 900 for use as a trash receptacle liner. The bag 900 may include a first sidewall 902 of thermoplastic material, a draw tape 904, a hem 906, a network pattern area 908 and a ribbed patterned area 909. The network patterned area 908 slightly overlaps the hem seal 910 and is a distance 922 below the bag top 912. The network patterned area 908 borders the ribbed patterned area 909. The ribbed patterned area 909 reaches to the bag bottom 914. The network patterned area 908 extends a distance 926 from top to bottom and typically extends across the entire width of the bag. The ribbed patterned area 909 extends a distance 928 from top to bottom and typically extends across the entire width of the bag. The distance 922 can have a first range of about 0.5 inches to 4.0 inches, a second range of about 1.0 inches to 3.0 inches, and a third range of about 1.5 inches to 2.5 inches. In one embodiment, the distance 922 may be about 2.0 inches. The distance 926 can have a first range of 0.25 inches to 12.0 inches, a second range of 0.5 inches to 8.0 inches, a third range of 0.5 inches to 4.0 inches. In one embodiment, the distance 926 may be about 4.0 inches. The distance 928 can have a first range of 10.0 inches to 22.0 inches, a second range of 12.0 inches to 21.0 inches, a third range of 14.0 inches to 20.0 inches. In one embodiment, the distance 928 may be about 21.0 inches.

Figure 15:
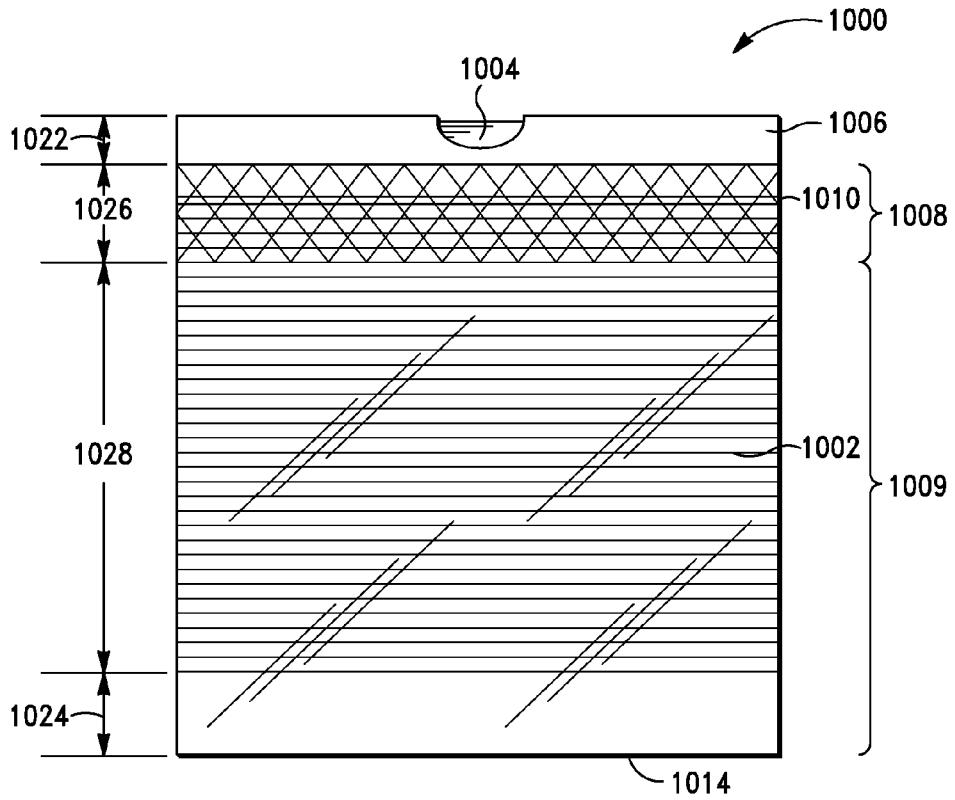
FIG. 15 is a front elevational view of another embodiment of the thermoplastic bag for use as a trash receptacle liner.

Referring now to FIG. 15, there is illustrated another embodiment of a bag 1000 for use as a trash receptacle liner. The bag 1000 may include a first sidewall 1002 of thermoplastic material, a draw tape 1004, a hem 1006, a network pattern area 1008 and a ribbed patterned area 1009. The network patterned area 1008 slightly overlaps the hem seal 910 and is a distance 1022 below the bag top 1012. The network patterned area 1008 borders the ribbed patterned area 1009. The ribbed patterned area 1009 does not reach to the bag bottom 1014 but is a distance 1024 from the bag bottom 1014. The network patterned area 1008 extends a distance 1026 from top to bottom and typically extends across the entire width of the bag. The ribbed patterned area 1009 extends a distance 1028 from top to bottom and typically extends across the entire width of the bag. The distance 1022 can have a first range of about 0.5 inches to 4.0 inches, a second range of about 1.0 inches to 3.0 inches, and a third range of about 1.5 inches to 2.5 inches. In one embodiment, the distance 1022 may be about 2.0 inches. The distance 1026 can have a first range of 0.25 inches to 12.0 inches, a second range of 0.5 inches to 8.0 inches, a third range of 0.5 inches to 4.0 inches. In one embodiment, the distance 1026 may be about 4.0 inches. The distance 1024 can have a first range of 0.25 inches to 12.0 inches, a second range of 0.5 inches to 8.0 inches, a third range of 0.5 inches to 4.0 inches. In one embodiment, the distance 1024 may be about 4.0 inches. The distance 1028 can have a first range of 10.0 inches to 22.0 inches, a second range of 12.0 inches to 21.0 inches, a third range of 14.0 inches to 20.0 inches. In one embodiment, the distance 1028 may be about 21.0 inches.

A network pattern may be formed in a variety of ways, for example forming a strainable network, embossing or printing. The network patterned area may exhibit a variety of functional properties. The network pattern area may be continuous across the width of the bag or discontinuous across the width of the bag. Though not bound by theory, the continuous network pattern may have advantages, for example gripping, over an unpatterned area. Though not bound by theory, the discontinuous network pattern may have advantages, for example strength, over an unpatterned area.

Figure 16:
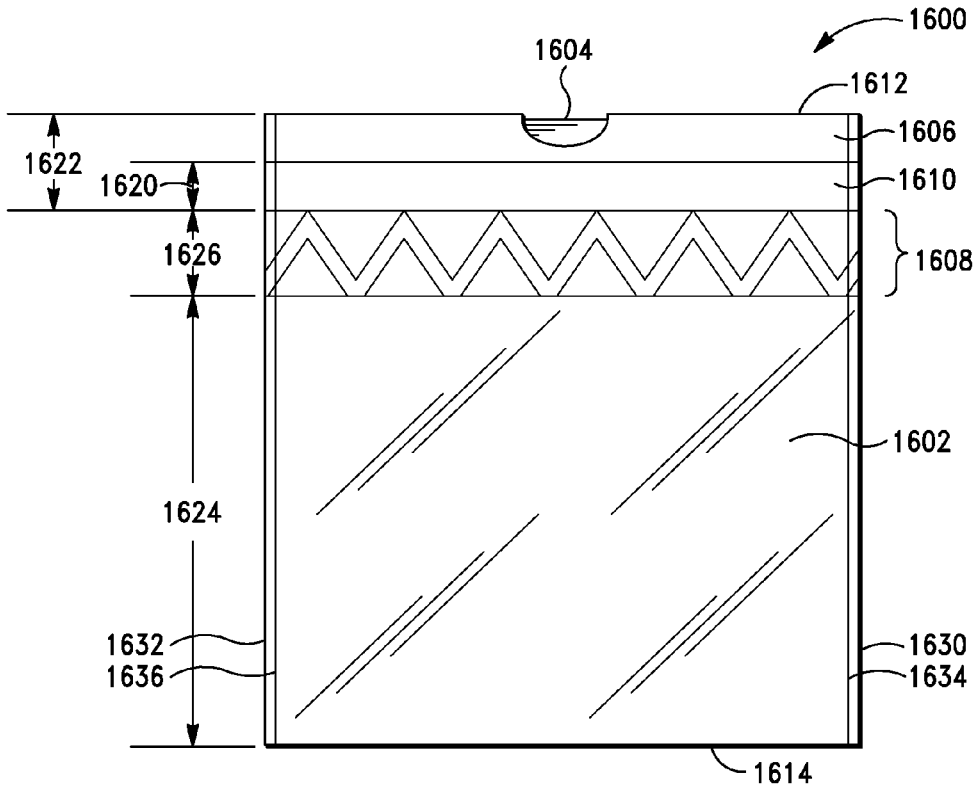
FIG. 16 is a front elevational view of another embodiment of the thermoplastic bag for use as a trash receptacle liner.

Referring now to FIG. 16, there is illustrated another embodiment of a bag 1600 for use as a trash receptacle liner. The bag 1600 may include a first sidewall 1602 of thermoplastic material, a draw tape 1604, a hem 1606, and a continuous network pattern area 1608. The continuous network pattern area 1608 is a distance 1620 below the hem seal 1610 and a distance 1622 below the bag top 1612. The continuous network patterned area 1608 does not reach to the bag bottom 1614 but is a distance 1624 from the bag bottom 1614. The continuous network patterned area 1608 extends a distance 1626 from top to bottom and typically extends across the entire width of the bag. Although the continuous network patterned area 1608 may result in greater loft to the film, the average thickness does not appreciably change compared to the unpatterned area. In one example, there is a consistent film thickness of about 0.95 mil from the bag top 1612 to the bag bottom 1614, noting that the bag top 1612 may have two film layers each having a consistent film thickness. The continuous network pattern area 1608 forms a pattern with icons extending continuously between the first side edge 1630 and the second side edge 1632. The network pattern 1608 may also extend across the first sidewall seam 1634 and second sidewall seam 1636.

The distance 1622 can have a first range of about 1.0 inches to 8.0 inches, a second range of about 1.5 inches to 4.0 inches, and a third range of about 2.0 inches to 3.0 inches. In one embodiment, the distance 1622 may be about 2.5 inches. The distance 1620 can have a first range of 0.25 inches to 7.0 inches, a second range of 0.25 inches to 4.0 inches, a third range of 0.5 inches to 2.0 inches. In one embodiment, the distance 1620 may be about 1.0 inches. The distance 1624 can have a first range of 0.25 inches to 24.0 inches, a second range of 4.0 inches to 22.0 inches, a third range of 10.0 inches to 21.0 inches. In one embodiment, the distance 1620 may be about 20.0 inches. The distance 1626 can have a first range of 1.0 inches to 7.0 inches, a second range of 1.0 inches to 4.0 inches, a third range of 1.0 inches to 2.0 inches. In one embodiment, the distance 1626 may be about 1.5 inches.

Figure 17:
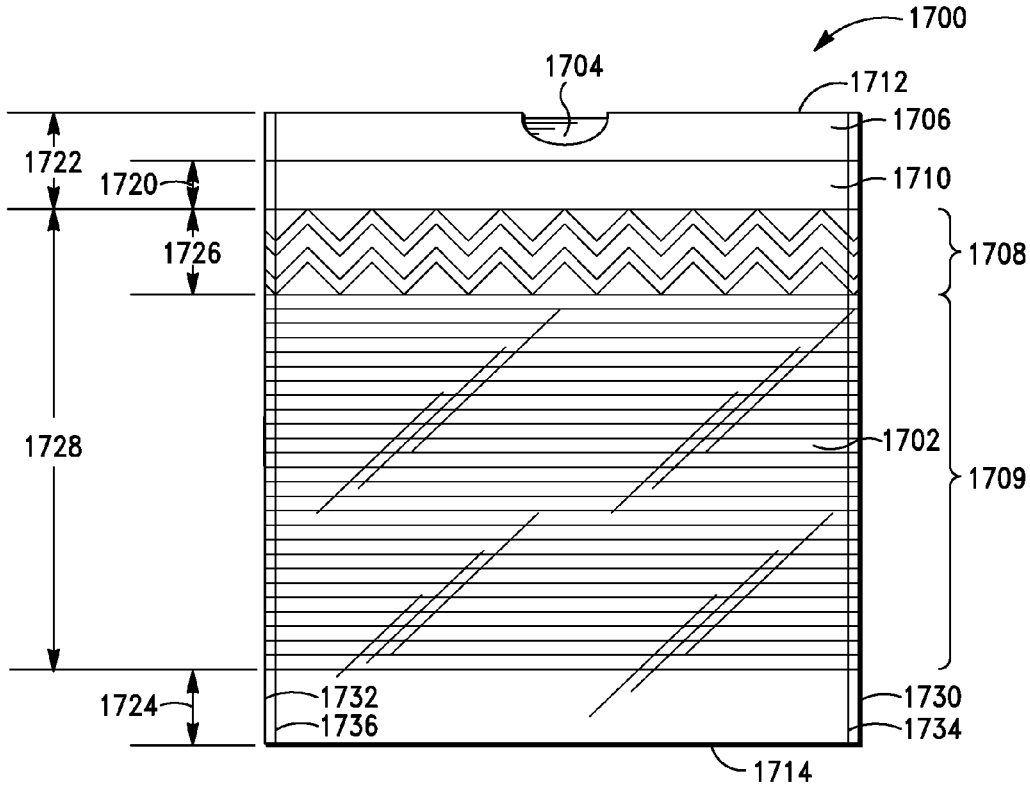
FIG. 17 is a front elevational view of another embodiment of the thermoplastic bag for use as a trash receptacle liner.

Referring now to FIG. 17, there is illustrated another embodiment of a bag 1700 for use as a trash receptacle liner. The bag 1000 may include a first sidewall 1702 of thermoplastic material, a draw tape 1704, a hem 1706, a continuous network pattern area 1708 and a ribbed patterned area 1709. The continuous network patterned area 1708 is a distance 1720 below the hem seal 1710 and a distance 1722 below the bag top 1712. The network patterned area 1708 borders the ribbed patterned area 1709. The ribbed patterned area 1709 does not reach to the bag bottom 1714 but is a distance 1724 from the bag bottom 1714. The continuous network pattern area 1708 forms a pattern with icons extending continuously between the first side edge 1730 and the second side edge 1732. The network pattern 1708 may also extend across the first sidewall seam 1734 and second sidewall seam 1736.

The network patterned area 1708 extends a distance 1726 from top to bottom and typically extends across the entire width of the bag. The ribbed patterned area 1709 extends a distance 1728 from top to bottom and typically extends across the entire width of the bag. The distance 1722 can have a first range of about 1.0 inches to 8.0 inches, a second range of about 1.5 inches to 4.0 inches, and a third range of about 2.0 inches to 3.0 inches. In one embodiment, the distance 1722 may be about 2.5 inches. The distance 1720 can have a first range of 0.25 inches to 7.0 inches, a second range of 0.25 inches to 4.0 inches, a third range of 0.5 inches to 2.0 inches.

In one embodiment, the distance 1720 may be about 1.0 inches. The distance 1724 can have a first range of 0.25 inches to 12.0 inches, a second range of 0.5 inches to 8.0 inches, a third range of 0.5 inches to 4.0 inches. In one embodiment, the distance 1724 may be about 4.0 inches. The distance 1726 can have a first range of 0.25 inches to 12.0 inches, a second range of 0.5 inches to 8.0 inches, a third range of 0.5 inches to 4.0 inches. In one embodiment, the distance 1726 may be about 4.0 inches. The distance 1728 can have a first range of 10.0 inches to 22.0 inches, a second range of 12.0 inches to 21.0 inches, a third range of 14.0 inches to 20.0 inches. In one embodiment, the distance 1728 may be about 21.0 inches.

Figure 18:
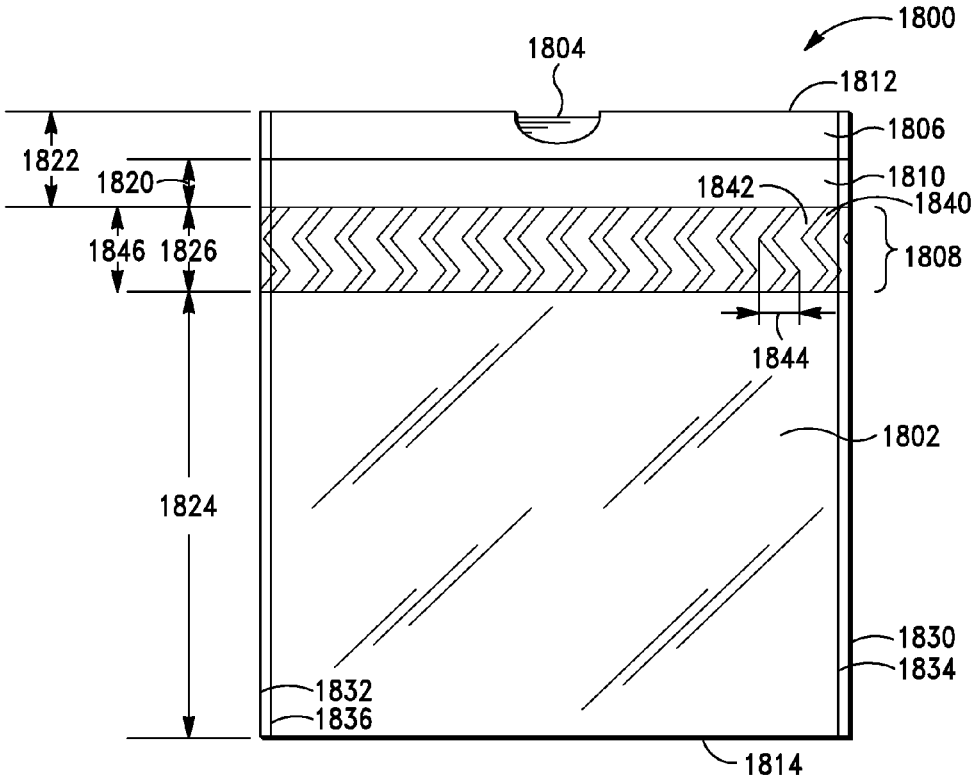
FIG. 18 is a front elevational view of another embodiment of the thermoplastic bag for use as a trash receptacle liner.

Referring now to FIG. 18, there is illustrated another embodiment of a bag 1800 for use as a trash receptacle liner. The bag 1800 may include a first sidewall 1802 of thermoplastic material, a draw tape 1804, a hem 1806, and a discontinuous network pattern area 1808. The discontinuous network pattern area 1808 forms a pattern with icons 1840 interrupted by smooth, unmarked, or unraised areas 1842 as the discontinuous network pattern area 1808 extends discontinuously between the first side edge 1830 and the second side edge 1832. The discontinuous network pattern area 1808 has icons 1840 with a maximum icon length 1844 measured in the direction across the width of the bag between the sidewalls and a maximum icon height 1846 measured in the direction across the height of the bag from the bag bottom 1814 to the bag top 1812.

The discontinuous network pattern area 1808 is a distance 1820 below the hem seal 1810 and a distance 1822 below the bag top 1812. The discontinuous network patterned area 1808 does not reach to the bag bottom 1814 but is a distance 1824 from the bag bottom 1814. The discontinuous network patterned area 1808 extends a distance 1826 from top to bottom and typically extends across the entire width of the bag. Although the discontinuous network patterned area 1808 may result in greater loft to the film, the average thickness does not appreciably change compared to the unpatterned area. In one example, there is a consistent film thickness of about 0.95 mil from the bag top 1812 to the bag bottom 1814, noting that the bag top 1812 may have two film layers each having a consistent film thickness. The discontinuous network pattern area 1808 forms a pattern with icons extending discontinuously between the first side edge 1830 and the second side edge 1832. The network pattern 1808 may also extend across the first sidewall seam 1834 and second sidewall seam 1836.

The distance 1822 can have a first range of about 1.0 inches to 8.0 inches, a second range of about 1.5 inches to 4.0 inches, and a third range of about 2.0 inches to 3.0 inches. In one embodiment, the distance 1822 may be about 2.5 inches. The distance 1820 can have a first range of 0.25 inches to 7.0 inches, a second range of 0.25 inches to 4.0 inches, a third range of 0.5 inches to 2.0 inches. In one embodiment, the distance 1820 may be about 1.0 inches. The distance 1824 can have a first range of 0.25 inches to 24.0 inches, a second range of 4.0 inches to 22.0 inches, a third range of 10.0 inches to 21.0 inches. In one embodiment, the distance 1820 may be about 20.0 inches. The distance 1826 can have a first range of 1.0 inches to 7.0 inches, a second range of 1.0 inches to 4.0 inches, a third range of 1.0 inches to 2.0 inches. In one embodiment, the distance 1826 may be about 1.5 inches.

Figure 19:
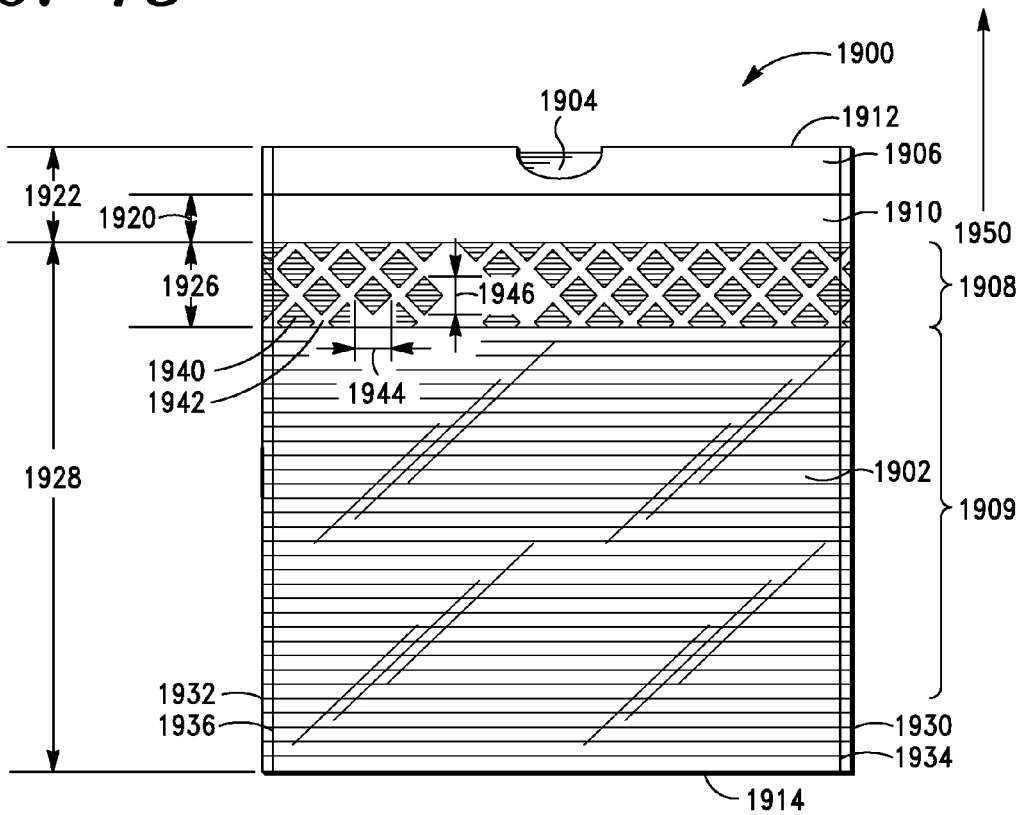
FIG. 19 is a front elevational view of another embodiment of the thermoplastic bag for use as a trash receptacle liner.
Figure 20:
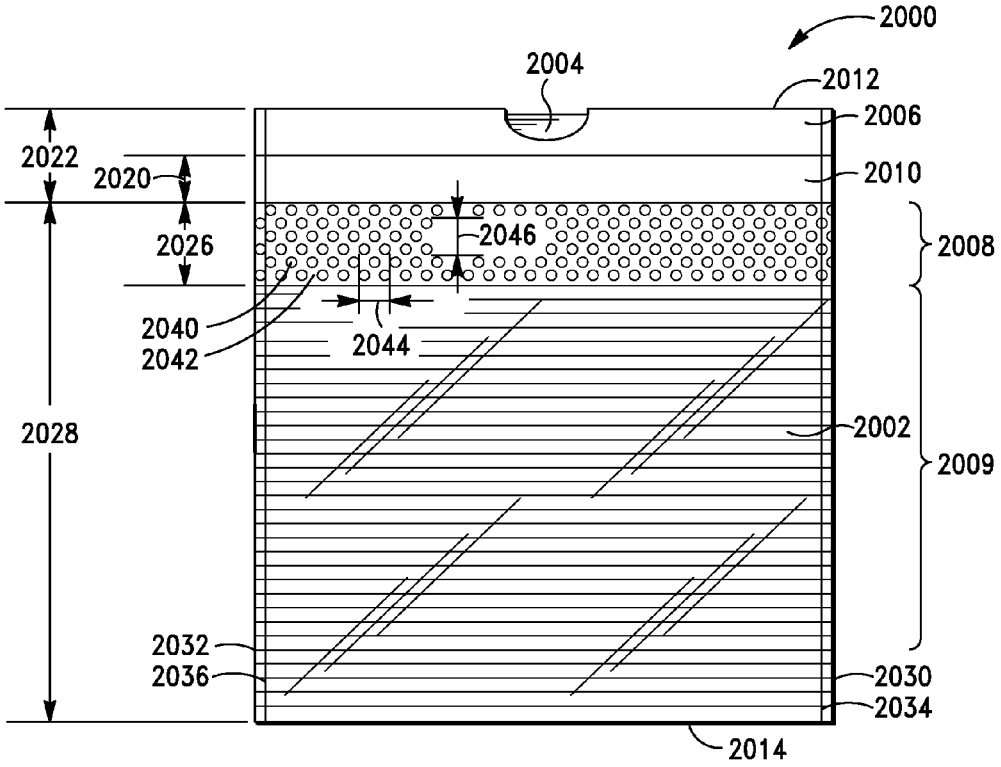
FIG. 20 is a front elevational view of another embodiment of the thermoplastic bag for use as a trash receptacle liner.
Figure 21:
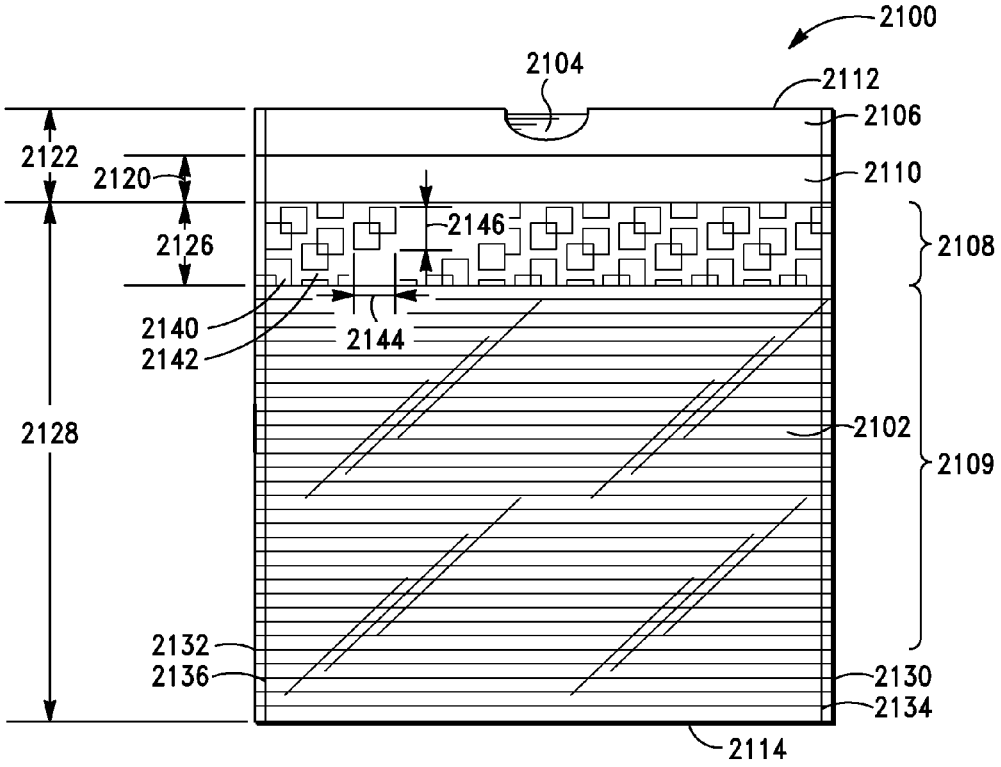
FIG. 21 is a front elevational view of another embodiment of the thermoplastic bag for use as a trash receptacle liner.
Figure 22:
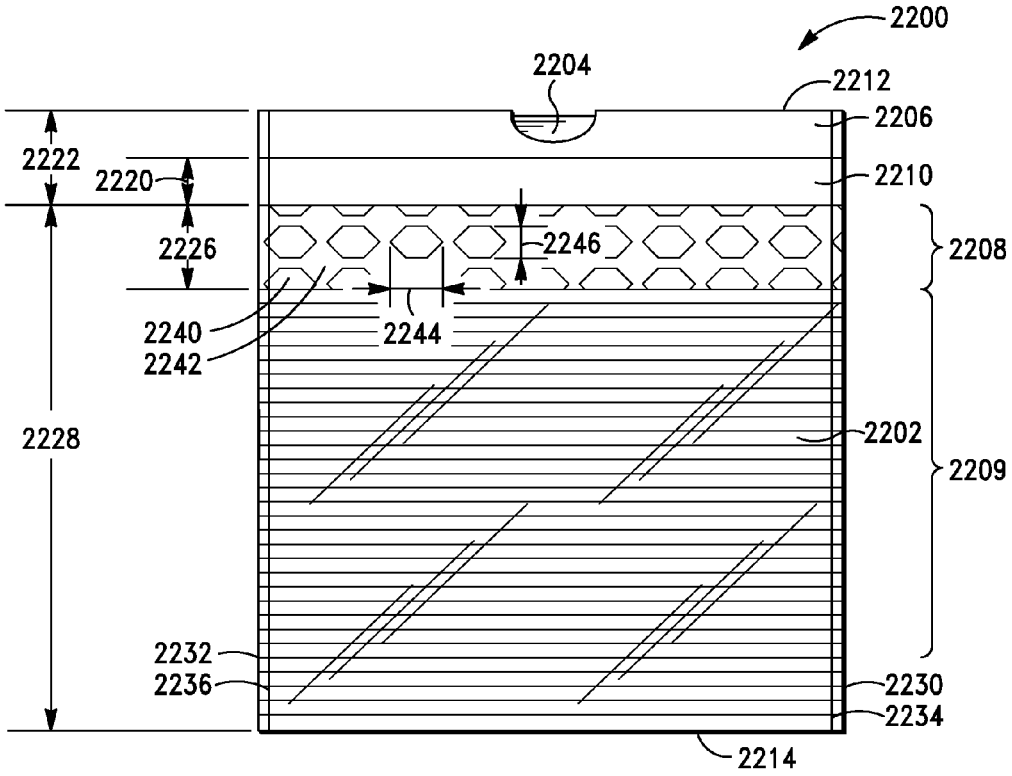
FIG. 22 is a front elevational view of another embodiment of the thermoplastic bag for use as a trash receptacle liner.
Figure 23:
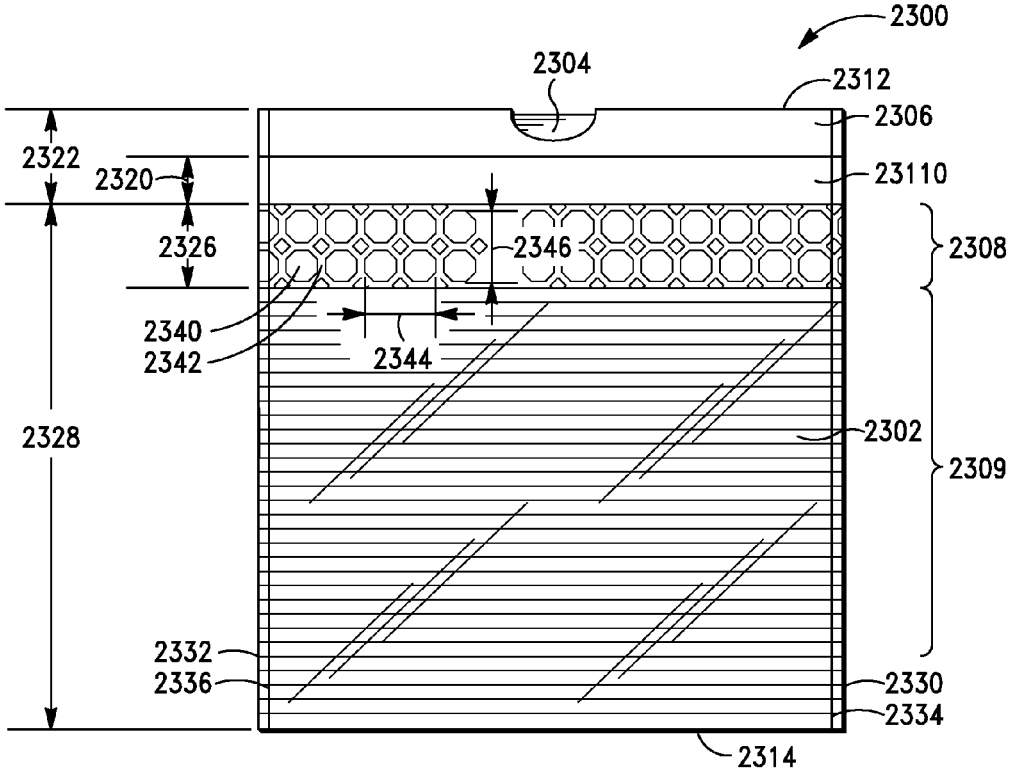
FIG. 23 is a front elevational view of another embodiment of the thermoplastic bag for use as a trash receptacle liner.
Figure 24:
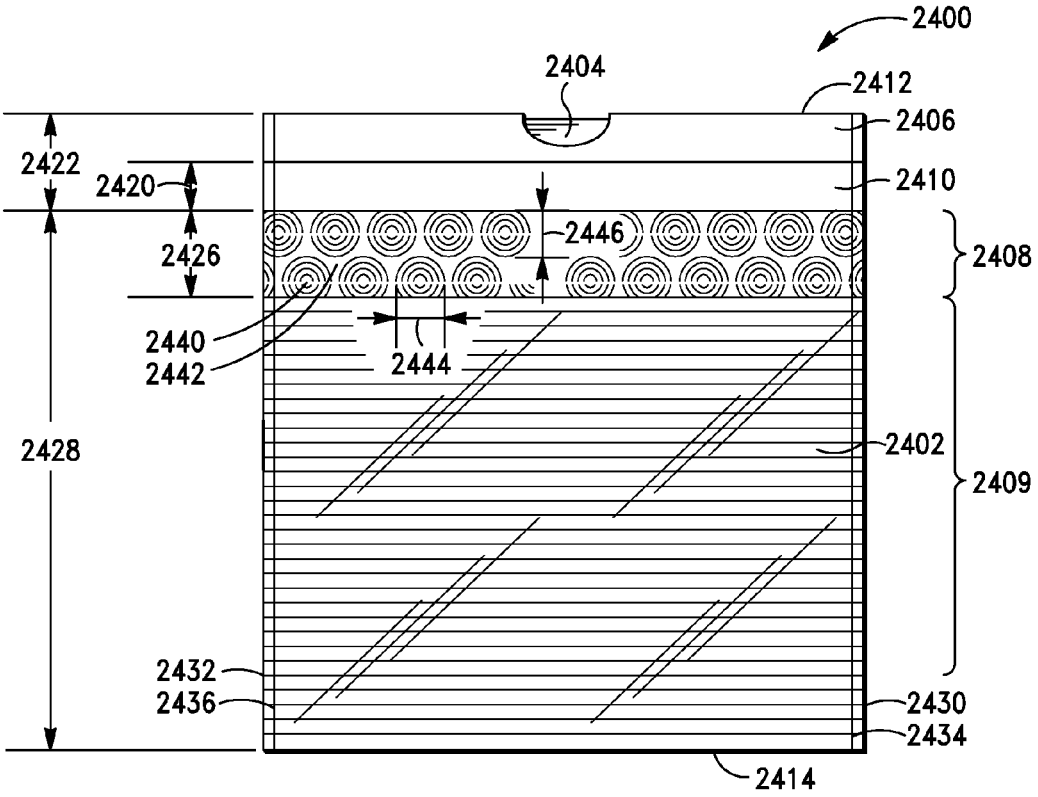
FIG. 24 is a front elevational view of another embodiment of the thermoplastic bag for use as a trash receptacle liner.
Figure 25:
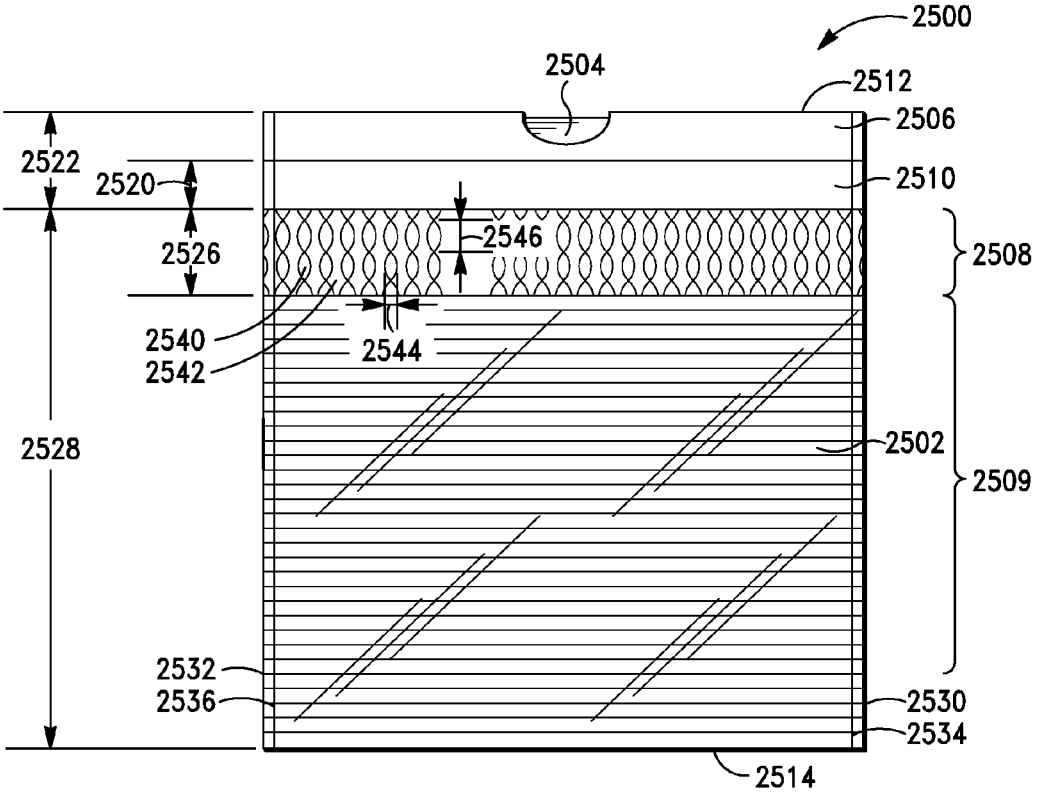
FIG. 25 is a front elevational view of another embodiment of the thermoplastic bag for use as a trash receptacle liner.
Figure 26:
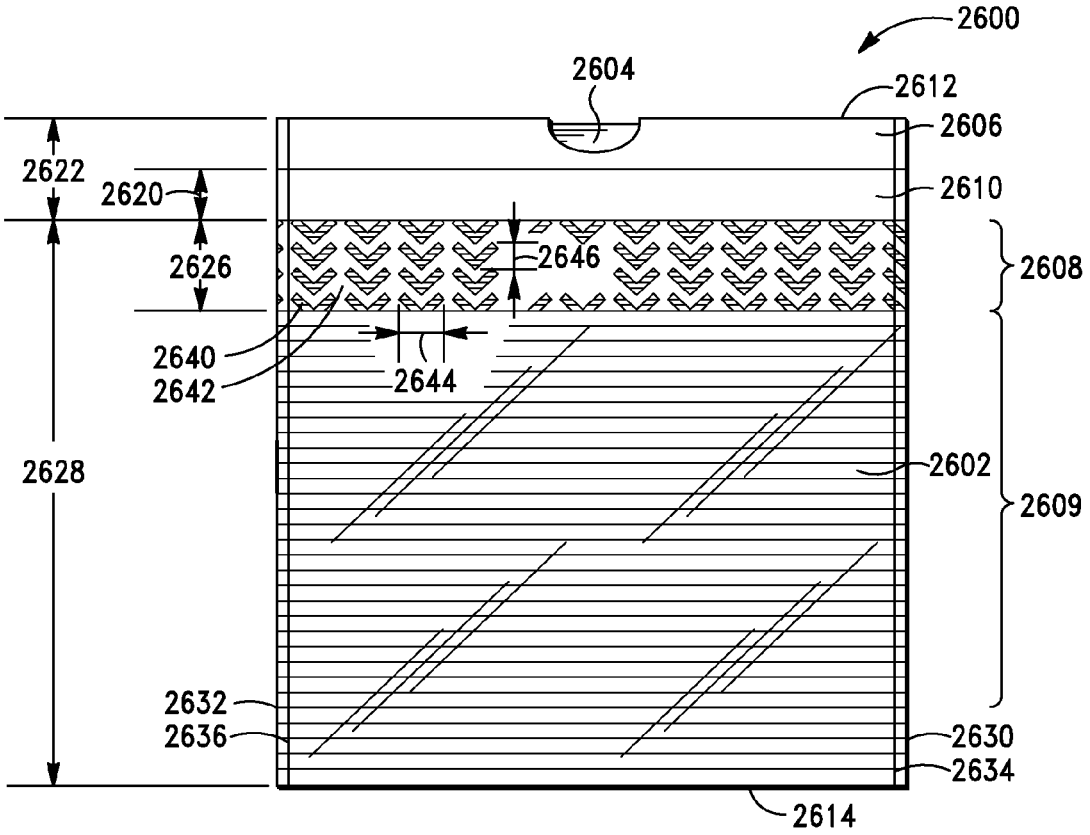
FIG. 26 is a front elevational view of another embodiment of the thermoplastic bag for use as a trash receptacle liner.

Referring now to FIG. 19, there is illustrated another embodiment of a bag 1900 for use as a trash receptacle liner. The bag 1900 may include a first sidewall 1902 of thermoplastic material, a draw tape 1904, a hem 1906, a discontinuous network pattern area 1908 and a ribbed patterned area 1909. The discontinuous network patterned area 1908 is a distance 1920 below the hem seal 1910 and a distance 1922 below the bag top 1912. The discontinuous network pattern area 1908 forms a pattern with icons 1940 interrupted by smooth, unmarked, or unraised areas 1942 as the discontinuous network pattern area 1908 extends discontinuously between the first side edge 1930 and the second side edge 1932. The discontinuous network pattern area 1908 has icons 1940 with a maximum icon length 1944 measured in the direction across the width of the bag between the sidewalls and a maximum icon height 1946 measured in the direction across the height of the bag from the bag bottom 1914 to the bag top 1912.

The network patterned area 1908 borders the ribbed patterned area 1909. The ribbed patterned area 1909 reaches to the bag bottom 1914. The discontinuous network pattern area 1908 forms a pattern with icons extending discontinuously between the first side edge 1930 and the second side edge 1932. The network pattern 1908 may also extend across the first sidewall seam 1934 and second sidewall seam 1936.

The network patterned area 1908 extends a distance 1926 from top to bottom and typically extends across the entire width of the bag. The ribbed patterned area 1909 extends a distance 1928 from top to bottom and typically extends across the entire width of the bag. The distance 1922 can have a first range of about 1.0 inches to 8.0 inches, a second range of about 1.5 inches to 4.0 inches, and a third range of about 2.0 inches to 3.0 inches. In one embodiment, the distance 1922 may be about 2.5 inches. The distance 1920 can have a first range of 0.25 inches to 7.0 inches, a second range of 0.25 inches to 4.0 inches, a third range of 0.5 inches to 2.0 inches. In one embodiment, the distance 1720 may be about 1.0 inches. The distance 1924 can have a first range of 0.25 inches to 12.0 inches, a second range of 0.5 inches to 8.0 inches, a third range of 0.5 inches to 4.0 inches. In one embodiment, the distance 1924 may be about 4.0 inches. The distance 1926 can have a first range of 0.25 inches to 12.0 inches, a second range of 0.5 inches to 8.0 inches, a third range of 0.5 inches to 4.0 inches. In one embodiment, the distance 1926 may be about 4.0 inches. The distance 1928 can have a first range of 10.0 inches to 22.0 inches, a second range of 12.0 inches to 21.0 inches, a third range of 14.0 inches to 20.0 inches. In one embodiment, the distance 1928 may be about 21.0 inches.

FIGS. 20-26 show additional discontinuous network patterns, including circles, interlocking squares, polygons, patterns of different polygons, patterns of curved lines, patterns of wavy lines, and patterns of V-shaped lines.

One example of a discontinuous network patterned area is the discontinuous, strainable network patterned area described in U.S. Pat. App. 2008/0137995 to Fraser et al. and incorporated by reference in its entirety herein. The sheet material of the network patterned area comprises a first region and a second region. The first region and said second region are comprised of the same material composition and each has an untensioned projected path length. The first region undergoes a substantially molecular-level deformation and the second region initially undergoes a substantially geometric deformation when the sheet material is subjected to an applied elongation in a direction substantially parallel to an axis in response to an externally-applied force upon the sheet material of the network patterned area. A band of such sheet material could be provided in one region of the bag forming a complete circular band around the bag body to provide a more localized stretch property.

Another suitable example of a discontinuous network pattern area is described in U.S. Pat. No. 5,518,801 to Chappell et al., incorporated in its entirety by reference herein. As shown in FIG. 19, the discontinuous strainable network pattern has at least two distinct and dissimilar regions, corresponding to an icon consisting of a strainable network region of substantially parallel rib-like elements and a smooth region between the icons of strainable network regions. The strainable network regions initially undergo a substantially geometric deformation in response to an applied strain in a direction substantially parallel to the axis.

In a suitable embodiment, the strainable network region is comprised of a plurality of raised rib-like elements. As used herein, the term "rib-like element" refers to an embossment, debossment or combination thereof which has a major axis and a minor axis. Preferably, the major axis is at least as long as the minor axis. The major axes of the rib-like elements are preferably oriented substantially perpendicular to the axis of applied strain. The major axis and the minor axis of the rib-like elements may each be linear, curvilinear or a combination of linear and curvilinear. In the case of a curvilinear element it may be more convenient to use a linear axis which represents an average of the curvilinear element. In the case of a draw tape bag, the axis of applied strain 1950 results from lifting the bag at the hem so that the axis goes from the bottom to the top of the bag.

The rib-like elements allow the strainable network region to undergo a substantially "geometric deformation" which results in significantly less resistive forces to an applied strain than that exhibited by the "molecular-level deformation" of the smooth region. As used herein, the term "molecular-level deformation" refers to deformation which occurs on a molecular level and is not discernible to the normal naked eye. That is, even though one may be able to discern the effect of molecular-level deformation, e.g., elongation of the smooth region, one is not able to discern the deformation which allows or causes it to happen. This is in contrast to the term "geometric deformation". As used herein the term "geometric deformation" refers to deformations of the discontinuous network film which are generally discernible to the normal naked eye when the discontinuous network film or articles embodying the discontinuous network film are subjected to an applied strain. Types of geometric deformation include, but are not limited to bending, unfolding, and rotating.

The discontinuous strainable network pattern may provide improved properties compared to a continuous smooth film. For example, the discontinuous strainable network pattern may provide improved tear and impact properties. This may especially be true when the discontinuous strainable network pattern is separated from the hem by a smooth region. Having a either a smooth area or a continuous ribbed area below the discontinuous network pattern may also improve the bag properties.

Additional examples of a network patterned area having lower surface contact would be an embossed network patterned area below the hem. The method of embossing the film of the present invention can involve calendar embossing the film with discrete "icons" to form raised icons extending beyond the plane of the film, each icon having an icon length and separated from adjacent icons by a non-raised portion. By "icon" as used herein is meant a single, discrete, design or shape, such as a heart, square, triangle, diamond, trapezoid, circle, polygon formed essentially as a line drawing. While certain icons may have portions not describable as a "line" (such as eyes of animals, etc.), the overall design comprises primarily lines in a pattern to make the design or shape. In one example in FIG. 20, the embossed icons are circles. In suitable examples, the raised icon area is larger than the non-raised area around the icons. Where the icons are printed, instead of embossed, the icons are not raised from the plane of the film but are separated from each other by the absence of lines. The icon area can represent greater than 10%, or greater than 50%, or greater than 60%, or greater than 70%, or greater than 80% of the total network patterned area. The film may be embossed with a pattern that provides texture to the film, but with no additional overall stretching. The film may be embossed by feeding between two rolls, one or both of which have an embossing pattern. The rolls may be heated or unheated.

The film may be coated or printed with an ink to form a network pattern. Depending upon the composition, various coating and printing process may be appropriate. For instance, in addition to ink jet printing and other non-impact printers, the composition can be used in screen printing processes, offset lithographic processes, flexographic printing processes, rotogravure printing processes, and the like. In other cases, a coating process may be appropriate. In the gravure coating process, an engraved roller runs in coating bath which fills the engraved recesses in engraved roller with excess additive delivery slurry. The excess slurry on engraved roller is wiped off engraved roller by doctor blade, with engraved roller thereafter depositing additive delivery slurry layer onto substrate film as substrate film passes between engraved roller and pressure roller.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments are described herein. Variations of those embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A thermoplastic bag comprising:

a first sidewall of flexible thermoplastic material;

a second sidewall of flexible thermoplastic material overlaying and joined to the first sidewall to form a first sidewall seam along a first side edge, to form a second sidewall seam along an opposite second side edge, and a closed bottom edge, the first and second sidewalls unjoined along respective top edges to define an opening opposite the bottom edge for accessing the interior volume and creating a sidewall interior surface in the interior volume and a sidewall exterior surface opposite the sidewall interior surface;

the first and second sidewalls forming a hem having a top length and extending along the open top end disposed opposite the bottom edge, the hem having a bottom length and a hem seal, the hem including one or more draw tape notches and a draw tape within the hem;

wherein the thermoplastic material of the first and second sidewalls is oriented such that the orientation of the thermoplastic material from the first side edge to the second side edge is machine direction, or MD, orientation and the orientation of the thermoplastic material from the closed bottom edge to the opening is transverse direction, or TD, orientation;

wherein the first and second sidewalls include a first portion with a discontinuous network pattern extending linearly between the first side edge and the second side edge and wherein the first portion with the discontinuous network pattern extends from above the bottom edge to below the hem seal such that there is a top un-patterned portion below the hem seal such that the bag shows an elastic characteristic in the first portion with a discontinuous network pattern;

wherein the bag comprises a second portion below the first portion, the second portion with a pattern of adjacent, linear ribs extending linearly between the first side edge and the second side edge, the ribs being substantially parallel and being formed with substantially equal indentations from the sidewall interior surface and the sidewall exterior surface such that the second portion is not elastic and shows decreased average thickness and increased TD tensile energy to yield at a constant or decreased tensile yield compared to the un-patterned portion.

2. The thermoplastic bag of claim 1, wherein the bag has a bottom un-patterned portion adjacent to the bottom edge.

3. The thermoplastic bag of claim 1, wherein the first portion has a first average thickness, the second portion has a second average thickness, the second average thickness is less than the first average thickness.

4. The thermoplastic bag of claim 3, wherein the second portion extends from the bottom edge.

5. The thermoplastic bag of claim 3, wherein the second portion is separated from the first portion by an un-patterned region.

6. The thermoplastic bag of claim 3, wherein the second portion is immediately adjacent to the first portion.

7. The thermoplastic bag of claim 3, wherein the second average thickness is about 85% or less of the first average thickness.

8. The thermoplastic bag of claim 1, wherein the first portion is a strainable network comprising a first region undergoing substantially molecular-level deformation and a second region undergoing substantially geometric deformation.

9. The thermoplastic bag of claim 3, wherein the first portion is a strainable network comprising a first region undergoing substantially molecular-level deformation and a second region undergoing substantially geometric deformation.

10. The thermoplastic bag of claim 1, wherein the discontinuous network pattern comprises strainable network elements of substantially parallel ribs and smooth, non-raised regions between the strainable network elements.

11. The thermoplastic bag of claim 3, wherein the discontinuous network pattern comprises strainable network elements of substantially parallel ribs and smooth, non-raised regions between the strainable network elements.

12. A thermoplastic bag comprising:

a first sidewall of flexible thermoplastic material;

a second sidewall of flexible thermoplastic material overlaying and joined to the first sidewall to form a first sidewall seam along a first side edge, to form a second sidewall seam along an opposite second side edge, and a closed bottom edge, the first and second sidewalls unjoined along respective top edges to define an opening opposite the bottom edge for accessing the interior volume;

the first and second sidewalls forming a hem having a top length and extending along the open top end disposed opposite the bottom edge, the hem having a bottom length and a hem seal, the hem including one or more draw tape notches and a draw tape within the hem;

wherein the thermoplastic material of the first and second sidewalls is oriented such that the orientation of the thermoplastic material from the first side edge to the second side edge is machine direction, or MD, orientation and the orientation of the thermoplastic material from the closed bottom edge to the opening is transverse direction, or TD, orientation;

wherein the first and second sidewalls includes a portion with a discontinuous network pattern extending linearly between the first side edge and the second side edge and across the first and second sidewall seams and below the hem seal;

wherein the bag comprises a second portion with a pattern of adjacent, linear ribs extending linearly between the first side edge and the second side edge, the ribs being substantially parallel and being formed with substantially equal indentations from the sidewall interior surface and the sidewall exterior surface such that the second portion is not elastic and shows decreased average thickness and increased TD tensile energy to yield at a constant or decreased TD tensile yield compared to the un-patterned portion;

wherein the second portion is below the first portion;

wherein the first portion has a first average thickness, the second portion has a second average thickness, the second average thickness is less than the first average thickness.

13. The thermoplastic bag of claim 12, wherein the second portion extends from the bottom edge.

14. The thermoplastic bag of claim 12, wherein the second portion is separated from the first portion by an un-patterned region.

15. The thermoplastic bag of claim 12, wherein the second portion is immediately adjacent to the first portion.

16. The thermoplastic bag of claim 12, wherein the first portion is a strainable network comprising a first region undergoing substantially molecular-level deformation and a second region undergoing substantially geometric deformation.

17. The thermoplastic bag of claim 1, wherein the discontinuous network pattern comprises strainable network elements of substantially parallel ribs and smooth, non-raised regions between the strainable network elements.

18. The thermoplastic bag of claim 12, wherein the bag has a bottom un-patterned portion adjacent to the bottom edge.

19. A thermoplastic bag comprising:

a first sidewall of flexible thermoplastic material;

a second sidewall of flexible thermoplastic material overlaying and joined to the first sidewall to form a first sidewall seam along a first side edge, to form a second sidewall seam along an opposite second side edge, and a closed bottom edge, the first and second sidewalls unjoined along respective top edges to define an opening opposite the bottom edge for accessing the interior volume;

the first and second sidewalls forming a hem having a top length and extending along the open top end disposed opposite the bottom edge, the hem having a bottom length and a hem seal, the hem including one or more draw tape notches and a draw tape within the hem;

wherein the thermoplastic material of the first and second sidewalls is oriented such that the orientation of the thermoplastic material from the first side edge to the second side edge is machine direction, or MD, orientation and the orientation of the thermoplastic material from the closed bottom edge to the opening is transverse direction, or TD, orientation;

wherein the first and second sidewalls includes a portion with a discontinuous network pattern extending linearly between the first side edge and the second side edge from below the hem seal to above the hem seal;

wherein the bag comprises a second portion with a pattern of adjacent, linear ribs extending linearly between the first side edge and the second side edge, the ribs being substantially parallel and being formed with substantially equal indentations from the sidewall interior surface and the sidewall exterior surface such that the second portion is not elastic and shows decreased average thickness and increased TD tensile energy to yield at a constant or decreased tensile yield compared to the un-patterned portion;

wherein the second portion is below the first portion.

* * * * *